US010960665B2

(12) United States Patent
Nomura et al.

(10) Patent No.: US 10,960,665 B2
(45) Date of Patent: Mar. 30, 2021

(54) ELEMENT SUBSTRATE, PRINTHEAD, AND PRINTING APPARATUS

(71) Applicant: CANON KABUSHIKI KAISHA, Tokyo (JP)

(72) Inventors: Hiroyasu Nomura, Inagi (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 16/361,365

(22) Filed: Mar. 22, 2019

(65) Prior Publication Data

US 2019/0299600 A1 Oct. 3, 2019

(30) Foreign Application Priority Data

Mar. 28, 2018 (JP) ..... JP2018-062259

(51) Int. Cl.
*B41J 2/045* (2006.01)
*B41J 2/14* (2006.01)

(52) U.S. Cl.
CPC ..... *B41J 2/04563* (2013.01); *B41J 2/0451* (2013.01); *B41J 2/0454* (2013.01); *B41J 2/0458* (2013.01); *B41J 2/04588* (2013.01); *B41J 2/14* (2013.01); *B41J 2002/14354* (2013.01)

(58) Field of Classification Search
CPC .... B41J 2/04563; B41J 2/0451; B41J 2/0458; B41J 2/04588; B41J 2/2142; B41J 2/0454; B41J 2/14; B41J 2002/14354
See application file for complete search history.

(56) References Cited

U.S. PATENT DOCUMENTS 6,505,904 B1 1/2003 Hirayama
7,690,751 B2 4/2010 Takabayashi et al.
7,914,106 B2 3/2011 Takabayashi et al.
8,210,640 B2 7/2012 Takabayashi et al.
8,888,217 B2 * 11/2014 Nishikawa ..... B41J 2/04588 347/10
2004/0095410 A1 * 5/2004 Miyashita ..... B41J 2/04555 347/19

FOREIGN PATENT DOCUMENTS

JP 4890960 B2 3/2012

* cited by examiner

*Primary Examiner* — Thinh H Nguyen
(74) *Attorney, Agent, or Firm* — Venable LLP

(57) ABSTRACT

An element substrate provided in a printhead includes a heater configured to heat ink and discharge the ink from a nozzle, a temperature sensor provided in correspondence with the heater, an electric current source configured to energize the temperature sensor with an electric current based on an electric current value specified by an externally input first signal, and a determination circuit configured to determine an ink discharge status of the nozzle based on a voltage output from the temperature sensor energized with the electric current and a threshold voltage specified by an externally input second signal, and output a determination result signal.

14 Claims, 20 Drawing Sheets

ELEMENT SUBSTRATE, PRINTHEAD, AND PRINTING APPARATUS

BACKGROUND OF THE INVENTION

Field of the Invention

The present invention relates to an element substrate, a printhead, and a printing apparatus, and particularly to, for example, a printing apparatus to which a printhead incorporating an element substrate with a plurality of print elements is applied to perform printing in accordance with an inkjet method.

Description of the Related Art

One of inkjet printing methods of discharging ink droplets from nozzles and adhering them to a paper sheet, a plastic film, or another print medium uses a printhead with print elements that generate thermal energy to discharge ink. As for a printing apparatus using a printhead according to this method, there is proposed a method of performing, based on an electrical variation of a circuit and a thermal variation of each nozzle, correction of an error in temperature signal output from a temperature sensor provided in correspondence with each heater (see Japanese Patent No. 4890960).

The printing apparatus disclosed in Japanese Patent No. 4890960 obtains a temperature signal without applying a drive pulse to a heater, thereby obtaining an offset voltage TEoff representing an electrical variation. Next, the printing apparatus obtains a temperature signal by applying a drive pulse to the heater, thereby obtaining a coefficient K representing a thermal variation. Then, the printing apparatus finally corrects an error in temperature signal using the obtained offset voltage TEoff and coefficient K, thereby outputting correct temperature information.

In the above conventional example, however, assume that signals of pieces of temperature information obtained at a plurality of timings are used as a criterion to determine the discharge status of a nozzle. Therefore, if the discharge status is determined based on a signal representing a temporal change in temperature information obtained from the temperature sensor, it is impossible to correct a drop amount of the tail (satellite) of an ink droplet discharged from the nozzle onto the heater or a variation in signal caused by a variation in timing. As a result, it is impossible to determine the discharge status with high accuracy.

Since the method according to the above conventional example is a method of performing correction by multiplying a signal based on temperature information by a gain, noise unwantedly increases together with a useful signal, and it is thus impossible to improve the accuracy of determination of the discharge status.

SUMMARY OF THE INVENTION

Accordingly, the present invention is conceived as a response to the above-described disadvantages of the conventional art.

For example, an element substrate, a printhead, and a printing apparatus according to this invention are capable of accurately determining the discharge status of a nozzle from a temperature sensor provided in correspondence with each nozzle.

According to one aspect of the present invention, there is provided an element substrate comprising: a heater configured to heat ink and discharge ink from a nozzle; a temperature sensor provided in correspondence with the heater; an electric current source configured to energize the temperature sensor with an electric current based on an electric current value specified by an externally input first signal; and a determination circuit configured to determine an ink discharge status of the nozzle based on a voltage output from the temperature sensor energized with the electric current and a threshold voltage specified by an externally input second signal, and output a determination result signal.

According to another aspect of the present invention, there is provided a printhead using an element substrate having the above arrangement.

According to still another aspect of the present invention, there is provided a printing apparatus comprising a printhead having the above arrangement, a signal generation unit configured to generate the first signal and the second signal, and transmit the first signal and the second signal to the printhead, a reception unit configured to receive the determination result signal, and a change unit configured to change at least one of a value of the first signal and a value of the second signal based on the determination result signal received by the reception unit.

The invention is particularly advantageous since a constant electric current with which the temperature sensor is energized or a threshold voltage for discharge status determination can be appropriately determined, and it is thus possible to determine the discharge status of a nozzle with high accuracy even for a nozzle or heater which has deteriorated due to various factors.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element (to be also referred to as a "nozzle" hereinafter)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing Apparatus Mounted With Full-Line Printhead (FIG. 1)>

Figure 1:
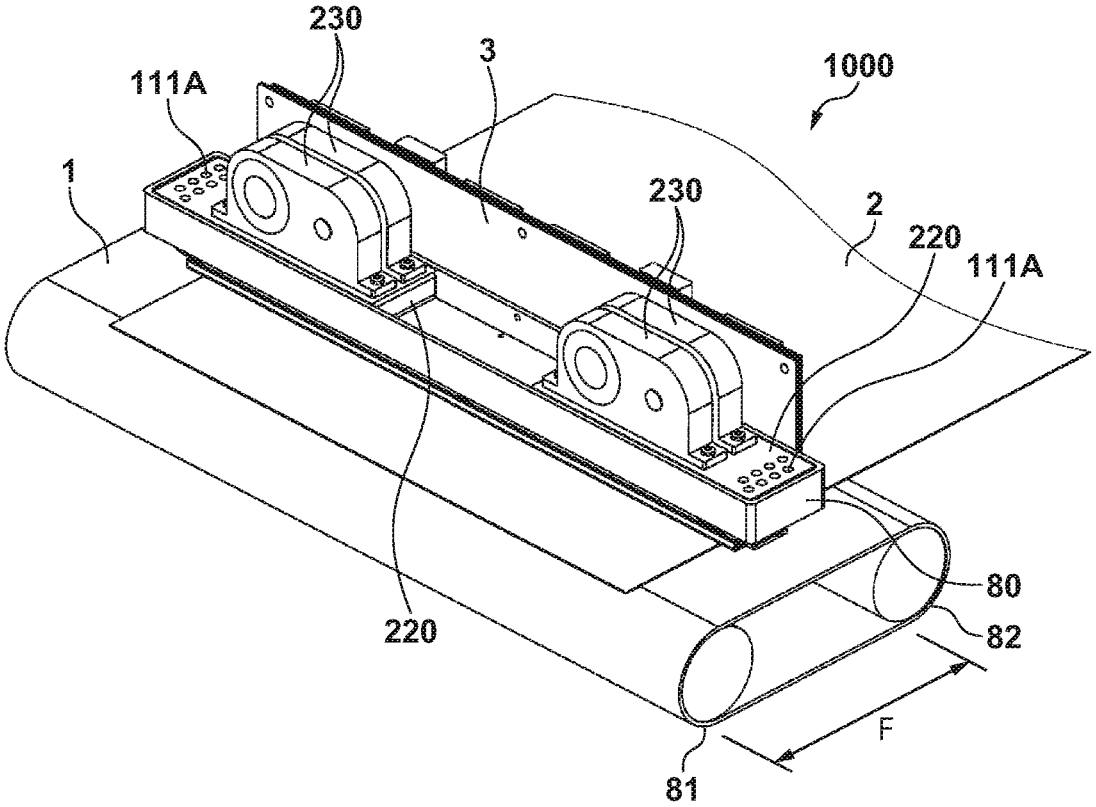
FIG. 1 is a perspective view for explaining the structure of a printing apparatus including a full-line printhead according to an exemplary embodiment of the present invention.

FIG. 1 is a perspective view showing the schematic arrangement of a printing apparatus 1000 using a full-line printhead that performs printing by discharging ink according to an exemplary embodiment of the present invention.

As shown in FIG. 1, the printing apparatus 1000 is a line type printing apparatus that includes a conveyance unit 1 that conveys a print medium 2 and a full-line printhead 3 arranged to be approximately orthogonal to the conveyance direction of the print medium 2, and performs continuous printing while conveying the plurality of print media 2 continuously or intermittently. The full-line printhead 3 is provided with a negative pressure control unit 230 that controls the pressure (negative pressure) in an ink channel, a liquid supply unit 220 that communicates with the negative pressure control unit 230, and a liquid connecting portion 111A that serves as an ink supply and discharge port to the liquid supply unit 220.

A housing 80 is provided with the negative pressure control unit 230, the liquid supply unit 220, and the liquid connecting portion 111A.

Note that the print medium 2 is not limited to a cut sheet, and may be a continuous roll sheet.

The full-line printhead (to be referred to as the printhead hereinafter) 3 can perform full-color printing by cyan (C), magenta (M), yellow (Y), and black (K) inks. A main tank and the liquid supply unit 220 serving as a supply channel for supplying ink to the printhead 3 are connected to the printhead 3. An electric controller (not shown) that transmits power and a discharge control signal to the printhead 3 is electrically connected to the printhead 3.

The print medium 2 is conveyed by rotating two conveyance rollers 81 and 82 provided apart from each other by a distance of F in the conveyance direction of the print medium 2.

The printhead according to this embodiment employs the inkjet method of discharging ink using thermal energy. Therefore, each orifice of the printhead 3 includes an electrothermal transducer (heater). The electrothermal transducer is provided in correspondence with each orifice. When a pulse voltage is applied to the corresponding electrothermal transducer in accordance with a print signal, ink is heated and discharged from the corresponding orifice. Note that the printing apparatus is not limited to the above-described printing apparatus using the full-line printhead whose printing width corresponds to the width of the print medium. For example, the present invention is also applicable to a so-called serial type printing apparatus that mounts, on a carriage, a printhead in which orifices are arrayed in the conveyance direction of the print medium and performs printing by discharging ink to the print medium while reciprocally scanning the carriage.

<Explanation of Control Arrangement (FIG. 2)>

Figure 2:
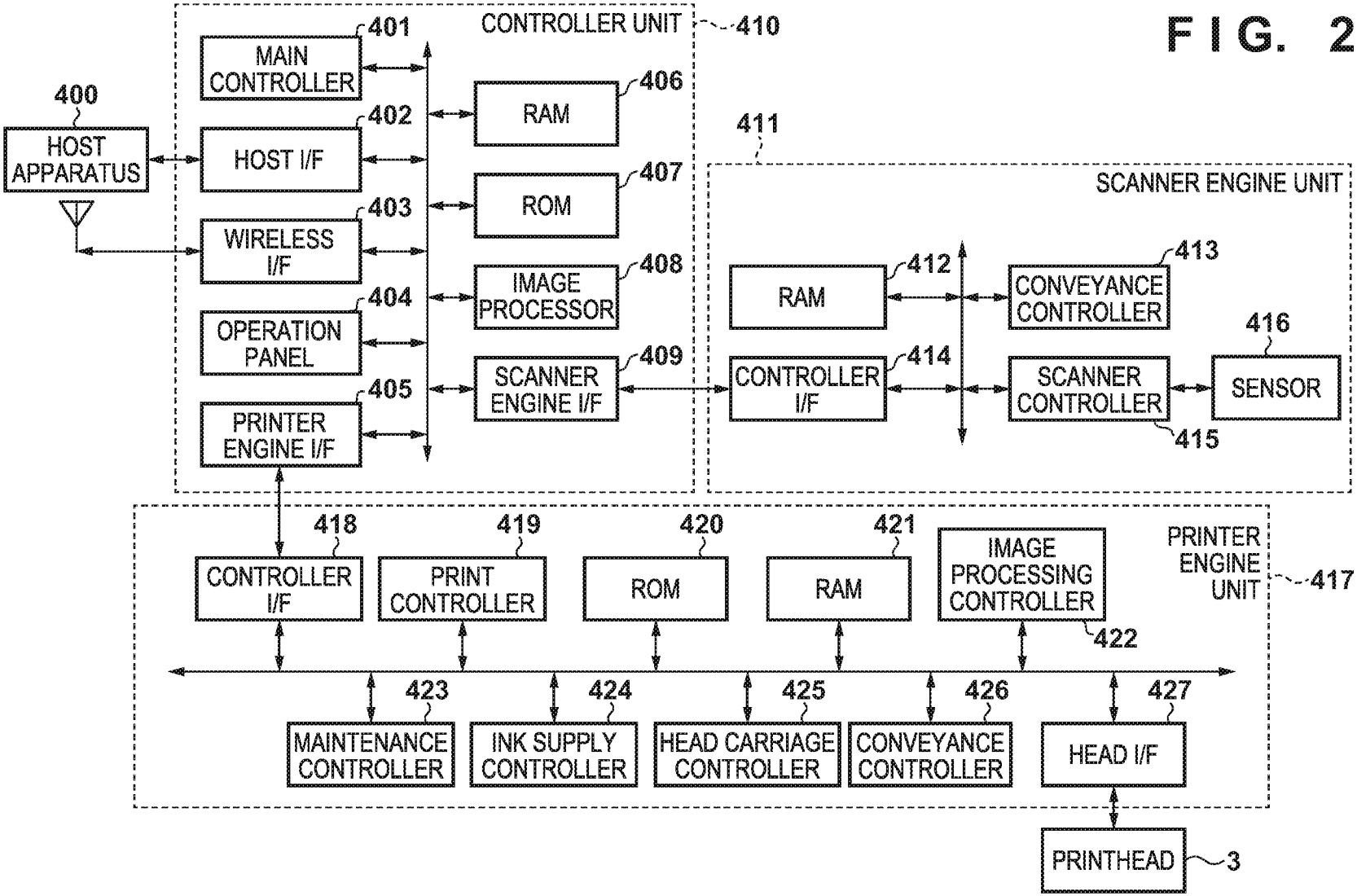
FIG. 2 is a block diagram showing the control arrangement of the printing apparatus shown in FIG. 1.

FIG. 2 is a block diagram showing the arrangement of the control circuit of the printing apparatus 1000.

As shown in FIG. 2, the printing apparatus 1000 is formed by a printer engine unit 417 that mainly controls a printing unit, a scanner engine unit 411 that controls a scanner unit, and a controller unit 410 that controls the overall printing apparatus 1000. A print controller 419 integrating an MPU and a non-volatile memory (EEPROM or the like) controls various mechanisms of the printer engine unit 417 in accordance with an instruction from a main controller 401 of the controller unit 410. The various mechanisms of the scanner engine unit 411 are controlled by the main controller 401 of the controller unit 410.

Details of the control arrangement will be described below.

In the controller unit 410, the main controller 401 formed by a CPU controls the overall printing apparatus 1000 by using a RAM 406 as a work area in accordance with a program and various parameters stored in a ROM 407. For example, if a print job is input from a host apparatus 400 via a host I/F 402 or a wireless I/F 403, an image processor 408 performs predetermined image processing for received image data in accordance with an instruction from the main controller 401. The main controller 401 transmits, to the printer engine unit 417 via a printer engine I/F 405, the image data having undergone the image processing.

Note that the printing apparatus 1000 may obtain image data from the host apparatus 400 via wireless or wired communication, or obtain image data from an external storage device (USB memory or the like) connected to the printing apparatus 1000. A communication method used for wireless or wired communication is not limited. For example, as a communication method used for wireless communication, Wi-Fi (Wireless Fidelity)® or Bluetooth® is applicable. Furthermore, as a communication method used for wired communication, USB (Universal Serial Bus) or the like is applicable. For example, if a read command is input from the host apparatus 400, the main controller 401 transmits the command to the scanner engine unit 411 via a scanner engine I/F 409.

An operation panel 404 is a unit used by the user to perform an input/output operation for the printing apparatus 1000. The user can instruct an operation such as a copy or scan operation via the operation panel 404, set a print mode, and recognize information of the printing apparatus 1000.

In the printer engine unit 417, the print controller 419 formed by a CPU controls the various mechanisms of the printer engine unit 417 by using a RAM 421 as a work area in accordance with a program and various parameters stored in a ROM 420.

Upon receiving various commands or image data via a controller I/F 418, the print controller 419 temporarily saves the received data in the RAM 421. So as to use the printhead 3 for a print operation, the print controller 419 causes an image processing controller 422 to convert the saved image data into print data. When the print data is generated, the print controller 419 causes, via a head I/F 427, the printhead 3 to execute a print operation based on the print data. At this time, the print controller 419 drives the conveyance rollers 81 and 82 via a conveyance controller 426 to convey the print medium 2. In accordance with an instruction from the print controller 419, a print operation is executed by the printhead 3 in synchronism with the conveyance operation of the print medium 2, thereby performing print processing.

A head carriage controller 425 changes the orientation and position of the printhead 3 in accordance with an operation status such as the maintenance status or print status of the printing apparatus 1000. An ink supply controller 424 controls the liquid supply unit 220 so that the pressure of ink supplied to the printhead 3 falls within an appropriate range. A maintenance controller 423 controls the operation of a cap unit or wiping unit in a maintenance unit (not shown) when performing a maintenance operation for the printhead 3.

In the scanner engine unit 411, the main controller 401 controls the hardware resources of a scanner controller 415 by using the RAM 406 as a work area in accordance with a program and various parameters stored in the ROM 407. This controls the various mechanisms of the scanner engine unit 411. For example, the main controller 401 controls the hardware resources in the scanner controller 415 via a controller I/F 414, and conveys, via a conveyance controller 413, a document stacked on an ADF (not shown) by the user, thereby reading the document by a sensor 416. Then, the scanner controller 415 saves read image data in a RAM 412.

Note that the print controller 419 can cause the printhead 3 to execute a print operation based on the image data read by the scanner controller 415 by converting, into print data, the image data obtained as described above.

<Explanation of Arrangement of Temperature Detection Element (FIGS. 3A to 3C)>

Figures 3A, 3B, 3C:
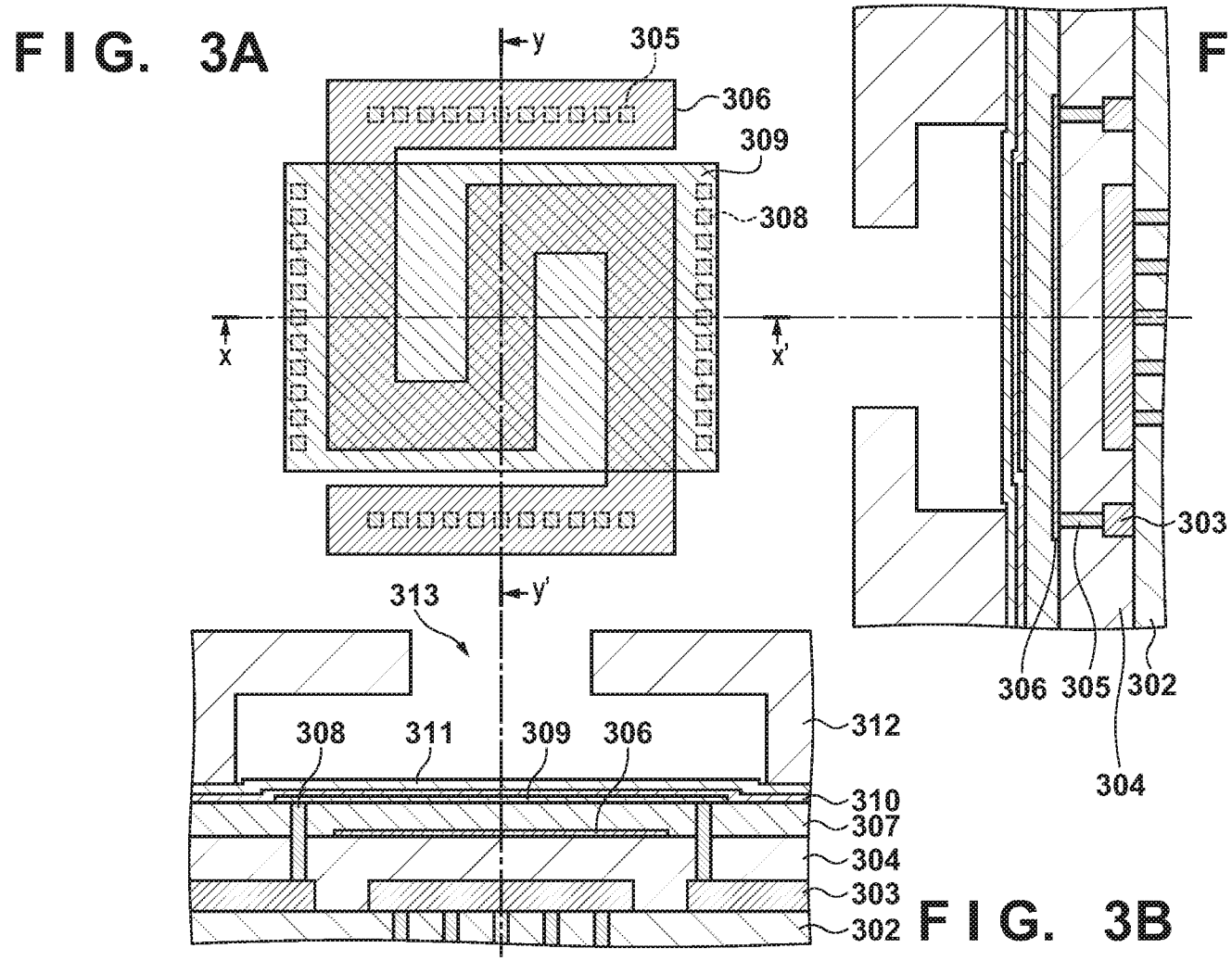
FIGS. 3A, 3B, and 3C are views each showing the multilayer wiring structure near a print element formed on a silicon substrate.

FIGS. 3A to 3C are views each showing the multilayer wiring structure near a print element formed on a silicon substrate.

FIG. 3A is a plan view showing a state in which a temperature detection element 306 is arranged in the form of a sheet in a layer below a print element 309 via an interlayer insulation film 307. FIG. 3B is a sectional view taken along a broken line x-x' in the plan view shown in FIG. 3A. FIG. 3C is a sectional view taken along a broken line y-y' shown in FIG. 3A.

In the x-x' sectional view shown in FIG. 3B and the y-y' sectional view shown in FIG. 3C, a wiring 303 made of aluminum or the like is formed on an insulation film 302 layered on the silicon substrate, and an interlayer insulation film 304 is further formed on the wiring 303. The wiring 303 and the temperature detection element 306 serving as a thin film resistor formed from a layered film of titanium and titanium nitride or the like are electrically connected via conductive plugs 305 which are embedded in the interlayer insulation film 304 and made of tungsten or the like.

Next, the interlayer insulation film 307 is formed below the temperature detection element 306. The wiring 303 and the print element 309 serving as a heating resistor formed by a tantalum silicon nitride film or the like are electrically connected via conductive plugs 308 which penetrate through the interlayer insulation film 304 and the interlayer insulation film 307, and made of tungsten or the like.

Note that when connecting the conductive plugs in the lower layer and those in the upper layer, they are generally connected by sandwiching a spacer formed by an intermediate wiring layer. When applied to this embodiment, since the film thickness of the temperature detection element serving as the intermediate wiring layer is as small as about several ten nm, the accuracy of overetching control with respect to a temperature detection element film serving as the spacer is required in a via hole process. In addition, the thin film is also disadvantageous in pattern miniaturization of a temperature detection element layer. In consideration of this situation, in this embodiment, the conductive plugs which penetrate through the interlayer insulation film 304 and the interlayer insulation film 307 are employed.

To ensure the reliability of conduction in accordance with the depths of the plugs, in this embodiment, each conductive plug 305 including one interlayer insulation film has a bore of 0.4 μm, and each conductive plug 308 in which the interlayer insulation film penetrates the two films has a larger bore of 0.6 μm.

Next, a head substrate (element substrate) is obtained by forming a protection film 310 such as a silicon nitride film, and then forming an anti-cavitation film 311 that contains tantalum or the like on the protection film 310. Furthermore, an orifice 313 is formed by a nozzle forming material 312 containing a photosensitive resin or the like.

As described above, the multilayer wiring structure in which an independent intermediate layer of the temperature detection element 306 is provided between the layer of the wiring 303 and the layer of the print element 309 is employed.

With the above arrangement, in the element substrate used in this embodiment, it is possible to obtain, for each print element, temperature information by the temperature detection element provided, in correspondence with each print element, immediately below the print element.

Based on the temperature information detected by the temperature detection element and a change in temperature, a logic circuit provided in the element substrate can obtain a determination result signal RSLT indicating the status of ink discharge from the corresponding print element. The determination result signal RSLT is a 1-bit signal, and "1" indicates normal discharge and "0" indicates a discharge failure.

<Explanation of Temperature Detection Arrangement when Viewed from Printing Apparatus Side (FIGS. 4A and 4B)>

Figure 4A:
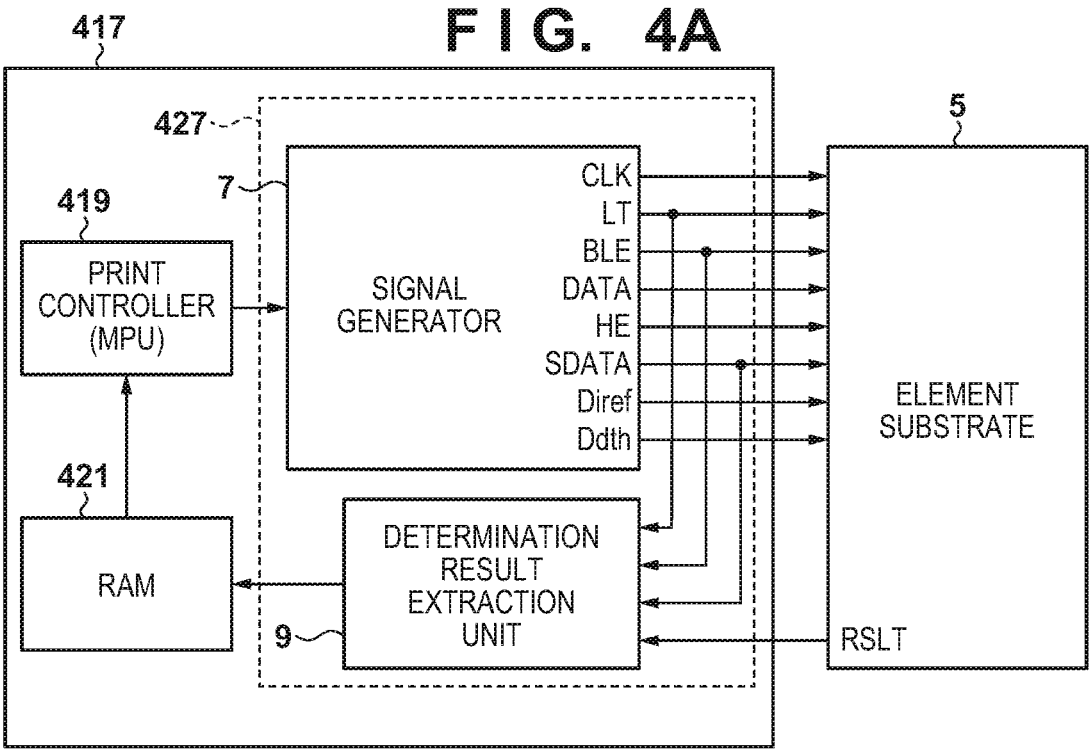
FIGS. 4A and 4B are block diagrams each showing a temperature detection control arrangement using the element substrate shown in FIGS. 3A, 3B, and 3C.
Figure 4B:
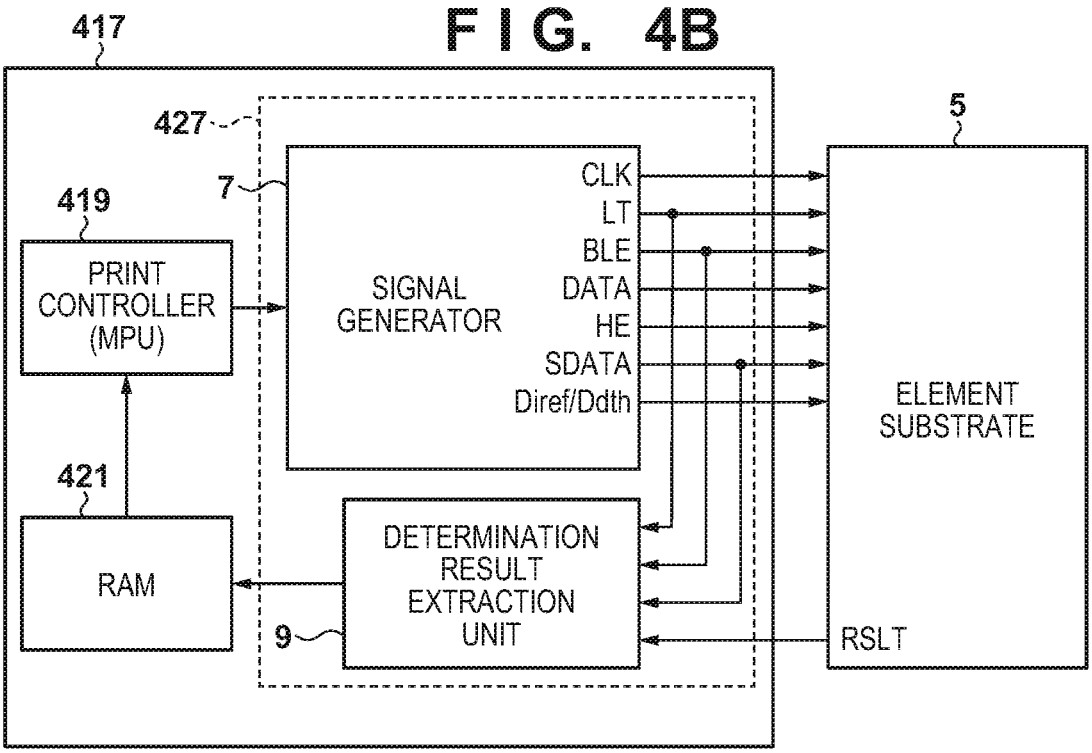

FIGS. 4A and 4B are block diagrams each showing a temperature detection control arrangement using the element substrate shown in FIGS. 3A to 3C.

As shown in FIG. 4A, to detect the temperature of the print element integrated in an element substrate 5, the printer engine unit 417 includes the print controller 419 integrating the MPU, the head I/F 427 for connection to the printhead 3, and the RAM 421. Furthermore, the head I/F 427 includes a signal generator 7 that generates various signals to be transmitted to the element substrate 5, and a determination result extraction unit 9 that receives the determination result signal RSLT output from the element substrate 5 based on the temperature information detected by the temperature detection element 306.

For temperature detection, when the print controller 419 issues an instruction to the signal generator 7, the signal generator 7 outputs a clock signal CLK, a latch signal LT, a block signal BLE, a print data signal DATA, and a heat enable signal HE to the element substrate 5. The signal generator 7 also outputs a sensor selection signal SDATA, a constant electric current signal Diref, and a discharge inspection threshold signal Ddth.

The sensor selection signal SDATA includes selection information for selecting the temperature detection element to detect the temperature information, energization quantity specifying information to the selected temperature detection element, and information pertaining to an output instruction of the determination result signal RSLT. If, for example, the element substrate 5 is configured to implement five print element arrays each including a plurality of print elements, the selection information included in the sensor selection signal SDATA includes array selection information for specifying an array and print element selection information for specifying a print element of the array. On the other hand, the element substrate 5 outputs the 1-bit determination result signal RSLT based on the temperature information detected by the temperature detection element corresponding to the one print element of the array specified by the sensor selection signal SDATA.

Note that this embodiment employs an arrangement in which the 1-bit determination result signal RSLT is output for the print elements of the five arrays. Therefore, in an arrangement in which the element substrate 5 implements 10 print element arrays, the determination result signal RSLT is a 2-bit signal, and this 2-bit signal is serially output to the determination result extraction unit 9 via one signal line.

As is apparent from FIG. 4A, the latch signal LT, the block signal BLE, and the sensor selection signal SDATA are fed back to the determination result extraction unit 9. On the other hand, the determination result extraction unit 9 receives the determination result signal RSLT output from the element substrate 5 based on the temperature information detected by the temperature detection element, and extracts a determination result during each latch period in synchronism with the fall of the latch signal LT. If the determination result indicates a discharge failure, the block signal BLE and the sensor selection signal SDATA corresponding to the determination result are stored in the RAM 421.

The print controller 419 erases a signal for the discharge failure nozzle from the print data signal DATA of a corresponding block based on the block signal BLE and the sensor selection signal SDATA which have been used to drive the discharge failure nozzle and stored in the RAM 421. The print controller 419 adds a nozzle for complementing non-discharge to the print data signal DATA of the corresponding block instead, and outputs the signal to the signal generator 7.

Note that the arrangement shown in FIG. 4A employs an arrangement in which the constant electric current signal Diref and the discharge inspection threshold signal Ddth are output to the element substrate 5 via different signal lines. The present invention, however, is not limited to this. Like an arrangement shown in FIG. 4B, an arrangement in which the constant electric current signal Diref and the discharge inspection threshold signal Ddth are output to the element substrate 5 via a common signal line may be employed. In this case, for example, the signal generator 7 serially outputs the constant electric current signal Diref and the discharge inspection threshold signal Ddth.

<Explanation of Circuit Arrangement of Element Substrate and Temperature Detection Arrangement in Element Substrate (FIGS. 5A to 8B)>

Figure 5A:
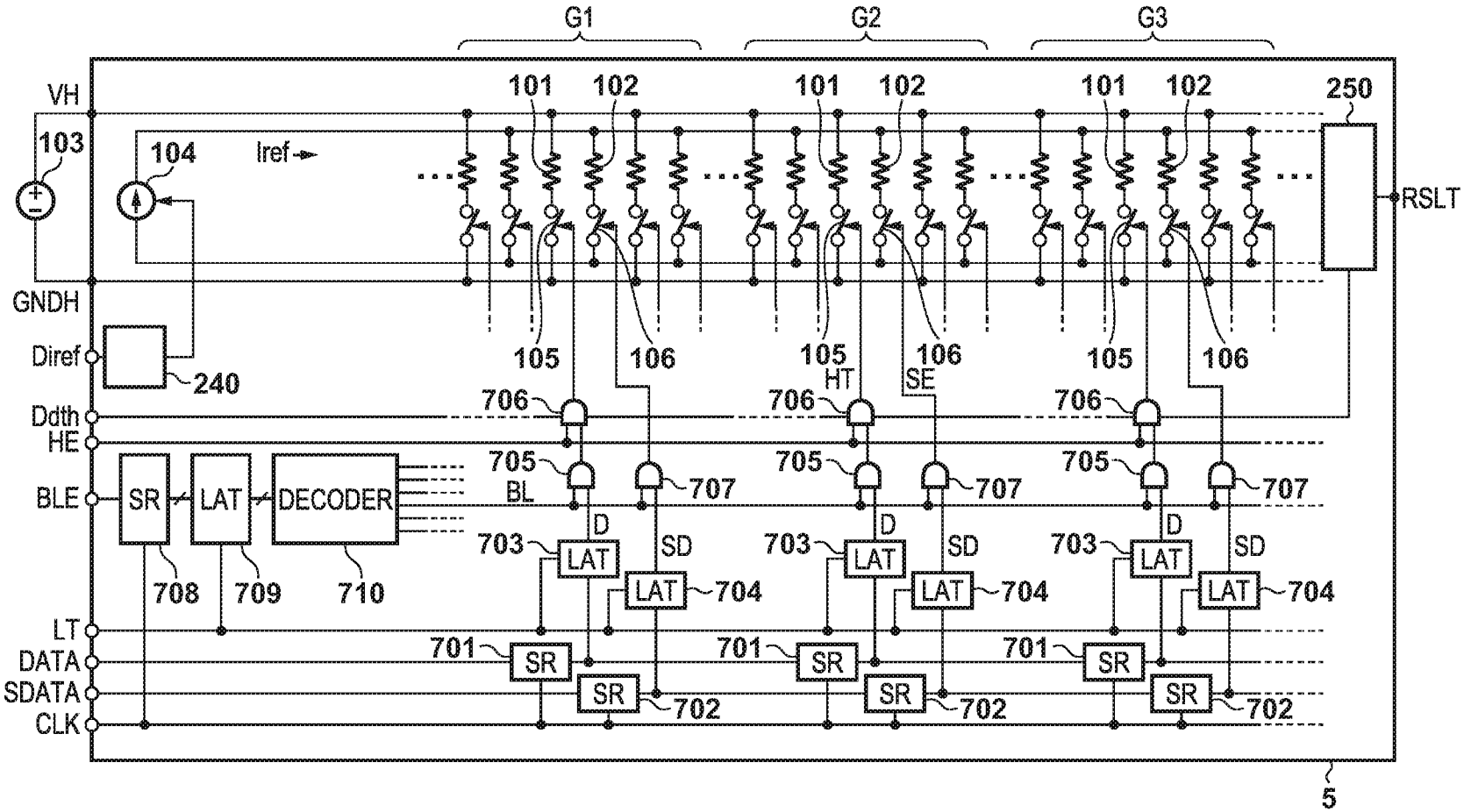
FIGS. 5A and 5B are circuit diagrams each showing the detailed internal circuit arrangement of an element substrate 5.
Figure 5B:
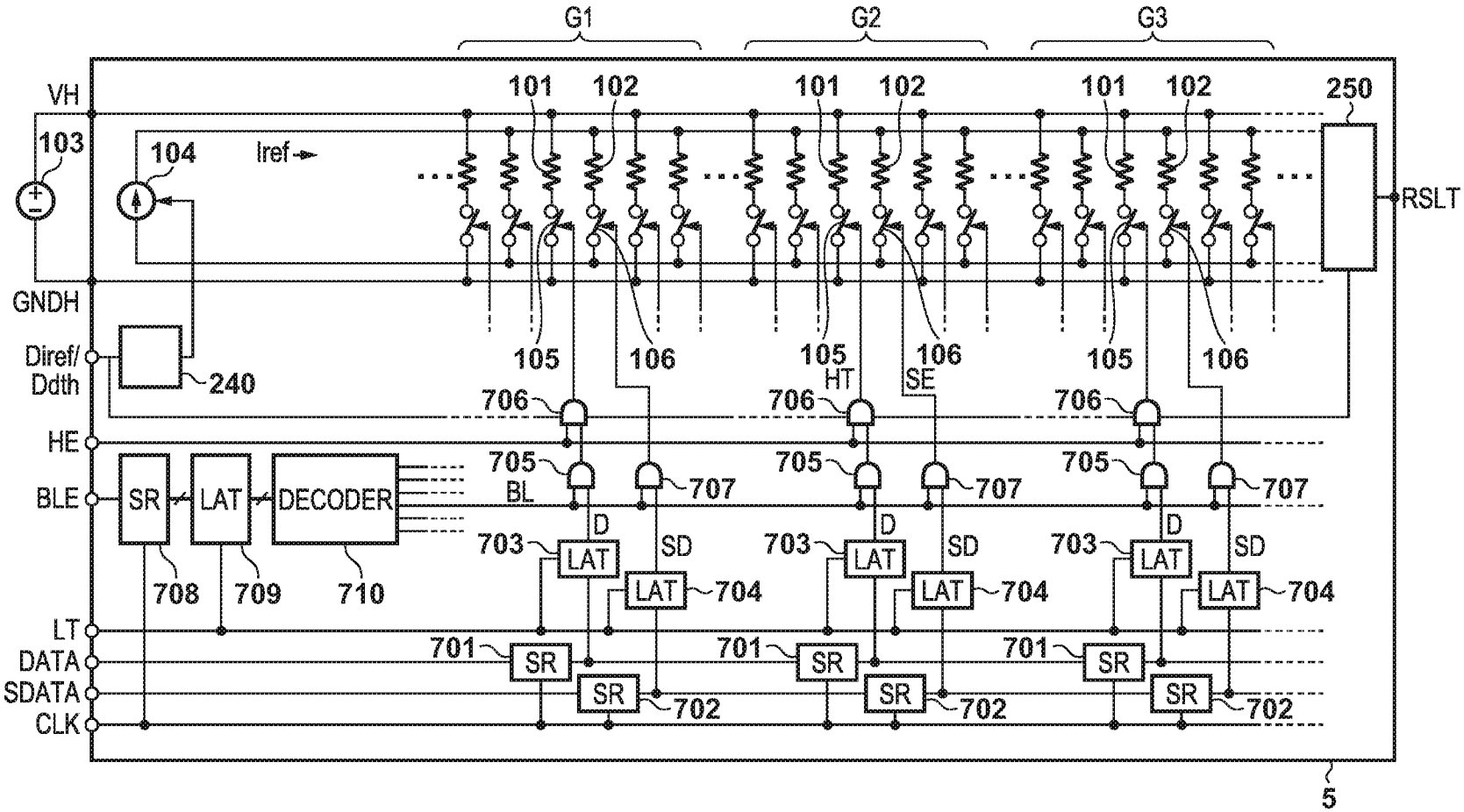

FIGS. 5A and 5B are circuit diagrams each showing the detailed internal circuit arrangement of the element substrate 5.

As is apparent from the multilayer wiring structure near the print element shown in FIGS. 3A to 3C, the temperature detection element 306 is formed in a layer below the print element 309. In correspondence with this, the element substrate 5 shown in FIG. 5A is provided with a plurality of pairs each including a heater 101 operating as the print element 309 and a temperature sensor 102 operating as the temperature detection element 306. Furthermore, a switch element 105 for turning on/off the heater 101 and a switch element 106 for turning on/off the temperature sensor 102 are connected to the heater 101 and the temperature sensor 102, respectively.

Note that the plurality of heaters 101 and the plurality of temperature sensors 102 are grouped so that a plurality of adjacent heaters are time-divisionally driven. Referring to FIG. 5A, these groups are indicated by G1, G2, G3 . . . .

A power supply 103 provided outside the element substrate 5 is parallel-connected to the plurality of heaters 101, and a constant electric current source 104 provided inside the element substrate 5 is parallel-connected to the plurality of temperature sensors 102. A constant electric current control circuit 240 that drives the constant electric current source 104 based on the input constant electric current signal Diref is connected to the constant electric current source 104. In addition, a determination circuit 250 that determines the discharge status of the print element (nozzle) based on the temperature detection signal output from one of these heaters is parallel-connected to the plurality of temperature sensors 102, and outputs the determination result signal RSLT.

To drive each heater 101, the print data signal DATA is received and input to a shift register (SR) 701 in accordance with the clock signal CLK, and latched by a latch circuit (LAT) 703 in accordance with the latch signal LT. Then, the latched signal is output as a heater selection signal D to an AND circuit 705. The heater selection signal D is held during a period T until the next latch timing, and the print data signal DATA is transferred to the shift register 701 during this period. For example, if the drive target nozzle belongs to the group G2, only the heater selection signal D input to the AND circuit 705 belonging to the group G2 is validated (High active), and the remaining heater selection signals D are set at Low level.

On the other hand, the block signal BLE is input to another shift register (SR) 708 in accordance with the clock signal CLK, and latched by another latch circuit (LAT) 709 in accordance with the latch signal LT. Then, the decoder 710 decodes the block signal BLE to generate a block selection signal BL, and outputs it to the AND circuit 705. The block selection signal BL output from a decoder 710 is output to wirings the number of which corresponds to the block division number. The block selection signal BL corresponding to the drive target nozzle is validated (High active), and held during the period T until the next latch timing, and the next block signal BLE is transferred to the shift register (SR) 708 during this period.

The logical product of the print data signal DATA and the block selection signal BL is calculated by the AND circuit 705, and the calculation result is output to an AND circuit 706. If the two input signals to the AND circuit 705 are valid (High active), the signal output from the AND circuit 705 is validated (High active). This signal is input to the AND circuit 706 as a signal for permitting driving of the heater 101. When the heat enable signal HE is input to the AND circuit 706, the AND circuit 706 outputs the heater drive signal HT based on the heat enable signal HE, and the switch element 105 is ON during a heater drive ON period. As a result, an electric current flows into the corresponding heater 101, and ink is heated by heat generated by the heater 101, and discharged.

In this embodiment, one temperature sensor 102 is selected by the sensor selection signal SDATA input at one timing. The sensor selection signal SDATA is received by a shift register (SR) 702 in accordance with the clock signal CLK, latched by a latch circuit (LAT) 704 in accordance with the latch signal LT, and output as a selection signal SD to an AND circuit 707. The selection signal SD is held during the period T until the next latch timing, and the sensor selection signal SDATA is transferred to the shift register 702 during this period. For example, if the temperature information detection target nozzle belongs to the group G2, only the selection signal SD input to the AND circuit 707 belonging to the group G2 is validated (High active), and the remaining selection signals SD are set at Low level.

On the other hand, the block selection signal BL is input to the AND circuit 707. That is, the block selection signal BL for selecting the heater 101 is used in common as a signal for selecting the temperature sensor 102 operating as the temperature detection element. Therefore, when the selection signal SD and the block selection signal BL are valid (High active), the AND circuit 707 outputs a sensor energization signal SE which is valid (High active) during the latch period T. The sensor energization signal SE turns on one switch element 106, the constant electric current Iref flows into one temperature sensor 102 corresponding to the switch element 106, and a potential difference (voltage) between the two terminals of the temperature sensor (resistor) 102 is input to the determination circuit 250.

Note that to output the temperature detection signal from the temperature sensor 102 when the heater 101 is not driven, a signal for validating (High active) only one selection signal SD is input while all the heater selection signals D are at Low level.

As is apparent from the above arrangement, the one constant electric current control circuit 240 and the one determination circuit 250, which are common to the plurality of temperature sensors 102 each serving as the temperature detection element provided in the element substrate 5, are provided. Therefore, at a given timing, the determination result signal RSLT based on the temperature information detected by the temperature sensor 102 selected by the sensor selection signal SDATA is output.

Note that to transfer the constant electric current signal Diref and the discharge inspection threshold signal Ddth to the element substrate 5 via the common signal line, as shown in FIG. 4B, the arrangement shown in FIG. 5B is employed as the internal circuit arrangement of the element substrate 5. That is, although FIG. 5A shows the arrangement including independent terminals for receiving the constant electric current signal Diref and the discharge inspection threshold signal Ddth, the arrangement including the common terminal for receiving the constant electric current signal Diref and the discharge inspection threshold signal Ddth, as shown in FIG. 5B, may be employed.

Figure 6:
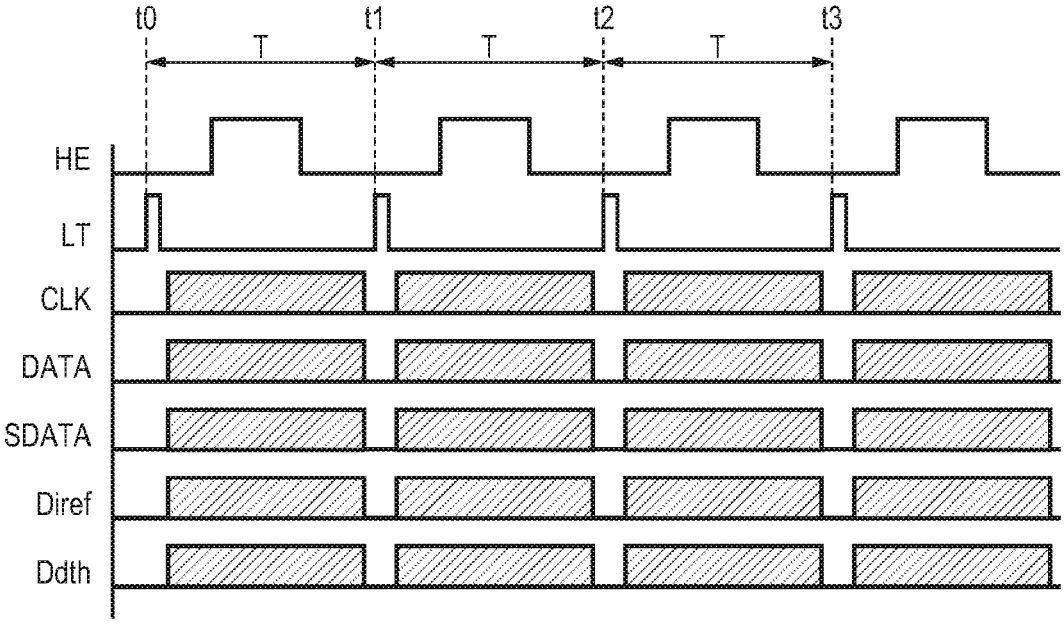
FIG. 6 is a timing chart showing respective signals input to the element substrate.

FIG. 6 is a timing chart showing the respective signals input to the element substrate.

As shown in FIG. 6, the element substrate 5 receives the clock signal CLK, the latch signal LT, the heat enable signal HE, the print data signal DATA, the sensor selection signal SDATA, the constant electric current signal Diref, and the discharge inspection threshold signal Ddth from the signal generator 7 of the printing apparatus. The signals other than the clock signal CLK are received for every latch period T.

Next, the circuit arrangement for generating, in the element substrate 5, the determination result signal RSLT from the temperature information detected by the one temperature sensor 102 will be described.

Figure 7A:
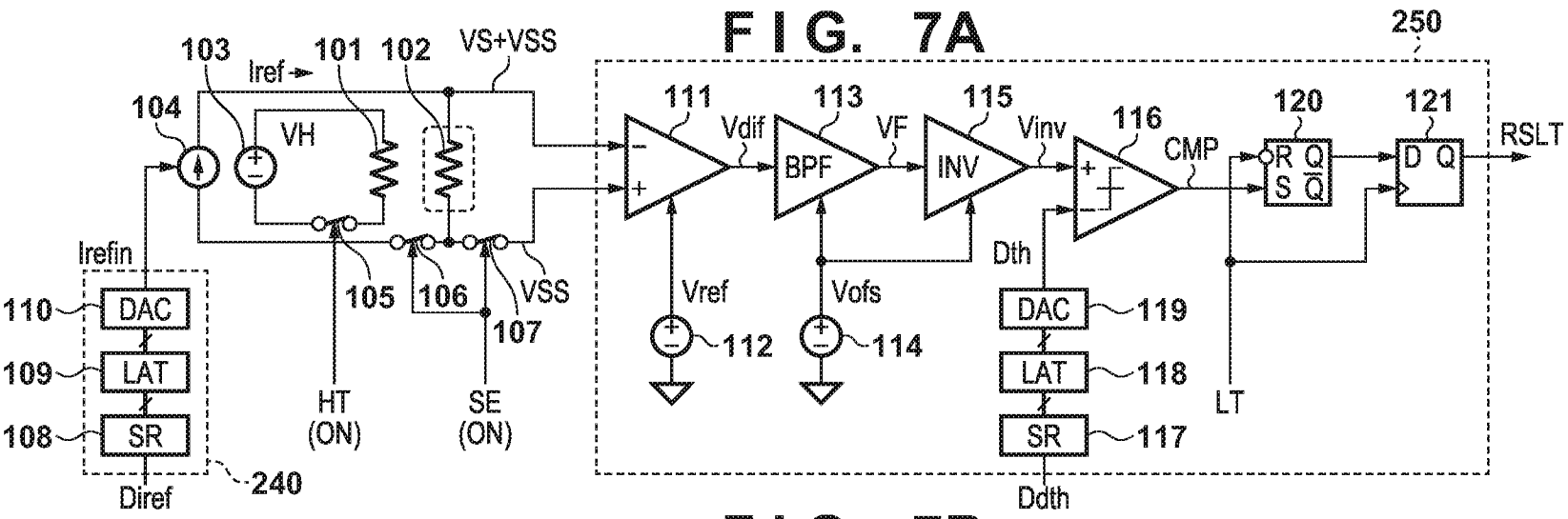
FIGS. 7A, 7B and 7C are circuit diagrams each showing a circuit arrangement for generating a determination result signal RSLT by paying attention to one heater (resistor)
Figure 7B:
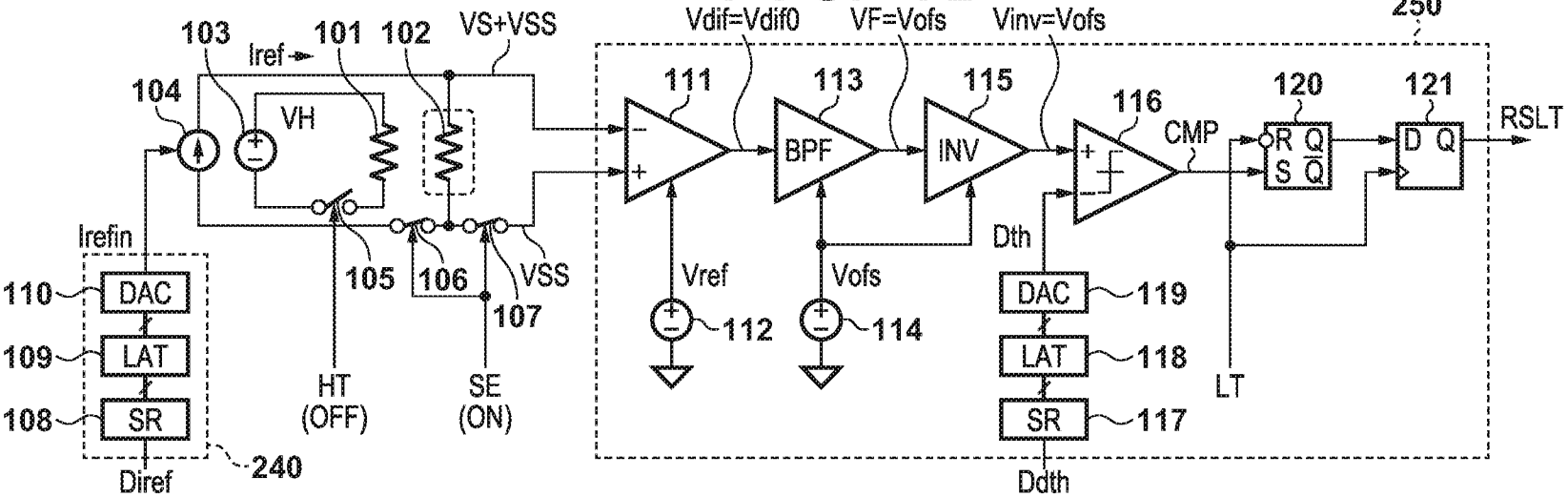

FIGS. 7A and 7B are circuit diagrams each showing the circuit arrangement for generating the determination result signal RSLT by paying attention to one heater (resistor). Note that in FIGS. 7A and 7B, the already described components and signals are denoted by the same reference numerals and symbols and a description thereof will be omitted.

FIG. 7A shows the input/output status of a circuit that processes the signals output from the temperature sensor 102 when the heater drive signal HT is applied to the heater 101. FIG. 7B shows the input/output status of a circuit that processes the signals output from the temperature sensor 102 when no heater drive signal HT is applied to the heater 101. Note that the temperature sensor 102 is formed by a thin film resistor.

Referring to FIG. 7A, when the heater drive signal HT is turned on (High active), the switch element 105 is closed (ON) and a constant voltage VH is applied to the heater 101. When the heater drive signal HT is turned off (Low), the switch element 105 is opened (OFF) and the application of the constant voltage VH to the heater 101 is shut off. In this way, the constant voltage VH is applied to the heater 101 in a rectangular pulse shape by turning on/off the heater drive signal HT.

On the other hand, when the sensor energization signal SE is turned on (High active), the switch element 106 is closed (ON) and the constant electric current Iref is supplied to the temperature sensor 102. At the same time, a switch element 107 is closed (ON) and voltage signals VSS and VS+VSS between the two terminals of the temperature sensor 102 are input to a differential amplifier 111.

Furthermore, when the sensor energization signal SE is turned off (Low), the switch elements 106 and 107 are opened (OFF), thereby shutting off the supply of the constant electric current Iref to the temperature sensor 102 and the input of the voltage signals between the two terminals of the temperature sensor 102 to the differential amplifier 111.

For example, the constant electric current Iref is settable by a step-width of 0.1 mA at 32 steps from 0.6 mA to 3.7 mA. A setting width of one step will be referred to as one rank hereinafter. As the rank increases, the electric current value increases. The constant electric current signal Diref that determines the setting value of the constant electric current Iref is determined as a 5-bit digital value settable at 32 steps, and transferred from the signal generator 7 to a shift register (SR) 108 in synchronism with the clock signal CLK.

The setting value determined by the constant electric current signal Diref is latched by a latch circuit 109 in synchronism with the latch signal LT, and output to a current output digital-to-analog converter (DAC) 110. The output signal of the latch circuit 109 is held during the period T until the next latch timing, and a setting value determined by the next constant electric current signal Diref is transferred from the signal generator 7 to the shift register 108 during this period. An output electric current Irefin of the DAC 110 is input to the constant electric current source 104, amplified by, for example, 12 times, and output as a constant electric current Iref. Note that in the figure, a clock signal inputted to the shift register 108 and a latch signal inputted to the latch circuit 109 are omitted for the sake of simplicity.

When T0 represents a normal temperature, Rs0 represents a resistance value at this time, and TCR represents a temperature resistance coefficient of the temperature sensor 102, a resistance Rs at a temperature T of the temperature sensor 102 is given by:

$$Rs=Rs0\{1+TCR(T-T0)\} \quad (1)$$

When the constant electric current Iref is supplied to the temperature sensor 102, a differential voltage VS between the two terminals is given by:

$$VS=Iref\cdot Rs=Iref\cdot Rs0\{1+TCR(T-T0)\} \quad (2)$$

The differential voltage VS is inverted and input to the differential amplifier 111. However, an output Vdif is a negative voltage equal to or lower than a ground potential GND, actually, Vdif=0 V is obtained, and is fed back to the negative terminal of the operational amplifier in the differential amplifier 111. Thus, an unexpected signal is finally output. To avoid this, a constant voltage source 112 applies, to the differential amplifier 111, an offset voltage Vref sufficient for the output Vdif to become equal to or higher than the ground potential GND.

As a result, when Gdif represents the amplification of the differential amplifier 111, the output Vdif from the differential amplifier 111 is given by:

$$Vdif=Vref-Gdif\cdot Vs \quad (3)$$

The output Vdif from the differential amplifier 111 is input to a bandpass filter (BPF) 113. The BPF 113 is a circuit for suppressing noise at the voltage Vdif, converting, into a peak, a signal obtained when a change is largest, and outputting the peak.

Figure 8A:
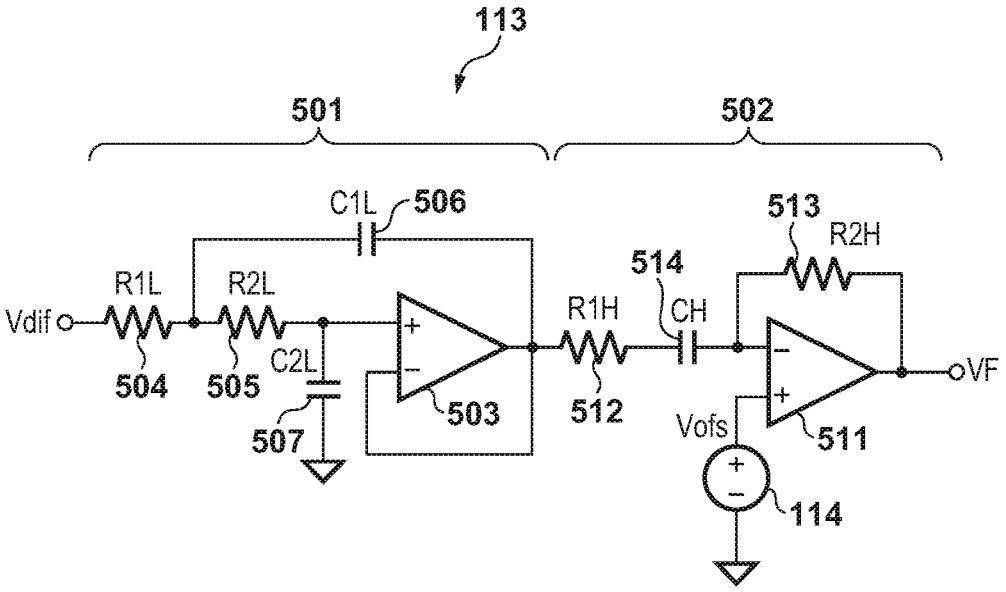
FIGS. 8A and 8B are circuit diagrams each showing the detailed arrangement of a bandpass filter (BPF) 113.
Figure 8B:
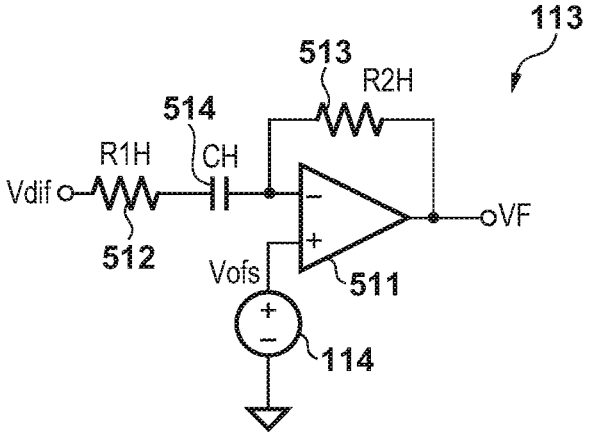

FIGS. 8A and 8B are circuit diagrams each showing the detailed arrangement of the bandpass filter (BPF) 113.

As shown in FIG. 8A, the BPF 113 is formed by a bandpass filter that cascade-connects a second-order low-pass filter 501 and a first-order high-pass filter 502. The low-pass filter (LPF) 501 is formed from an operational amplifier 503, a resistor R1L 504, a resistor R2L 505, a capacitor C1L 506, and a capacitor C2L 507. The LPF 501 has a predetermined passband and attenuates high-frequency noise on a higher-frequency band side than a cutoff frequency fcL. The cutoff frequency fcL here is obtained by:

$$fcL=1/[2\pi\cdot\sqrt{(R1L\cdot R2L\cdot C1L\cdot C2L)}] \quad (4)$$

On the other hand, the high-pass filter (HPF) 502 is formed from an operational amplifier 511, a resistor R1H 512, a resistor R2H 513, a capacitor CH 514, and the constant voltage source 114. The HPF 502 has a predetermined passband, extracts a gradient at the time of a temperature drop by performing the first-order derivative of a lower-frequency band side than a cutoff frequency fcH, and removes a DC component. The cutoff frequency fcH here is obtained by:

$$fcH=1/(2\pi\cdot R1H\cdot CH) \quad (5)$$

With signal processing by the BPF 113 with the above-described arrangement, the BPF 113 outputs a signal VF to be the basis of determining one of normal discharge and a discharge failure.

Note that if the positive terminal of the operational amplifier 511 is grounded directly, the signal VF may become a negative voltage equal to or lower than the ground potential GND. At this time, VF=0 V is obtained actually and fed back to the negative terminal of the operational amplifier 511, ending up in outputting the unexpected signal VF. To avoid this, in this embodiment, the constant voltage source 114 applies, to the positive terminal, an offset voltage Vofs sufficient for the signal VF to become equal to or higher than the ground potential GND.

If the LPF 501 cannot attenuate high-frequency noise included in the signal Vdif sufficiently, the two LPFs 501 may be cascade-connected. Conversely, if the high-frequency noise included in the signal Vdif is at a level where it can pass through the HPF 502 directly without any problem, the BPF 113 may be formed from only the HPF 502 by omitting the LPF 501, as shown in FIG. 8B.

Referring back to FIG. 7A, since the HPF 502 attenuates a low-frequency signal to decrease an output voltage, the output signal VF of the BPF 113 is amplified by an inversion amplifier (INV) 115 of the subsequent stage. Since, in the inversion amplifier 115, the input signal VF of a positive voltage is inverted to be a negative voltage, the voltage of the signal is increased by applying the offset voltage Vofs, similar to the HPF 502. In this example, the output from the constant voltage source 114 that applies the offset voltage Vofs to the HPF 502 is branched to apply the same offset voltage Vofs to the inversion amplifier 115. As a result, when Ginv represents the amplification of the inversion amplifier 115, an output signal Vinv of the inversion amplifier 115 is given by:

$$Vinv=Vofs+Ginv(Vofs-VF) \quad (6)$$

If, as shown in FIG. 7B, the temperature indicated by the temperature information of the temperature sensor 102 remains at the normal temperature T0 without applying the heater drive signal HT to the heater 101, in accordance with equations (2) and (3), the output Vdif from the differential amplifier 111 is given by:

$$Vdif0=Vref-Gdif\cdot Iref\cdot Rs0 \quad (7)$$

That is, since the output Vdif is a constant voltage, and the output signal VF of the BPF 113 becomes the offset voltage Vofs, the second term is erased from equation (6), and the output signal Vinv of the inversion amplifier 115 also becomes Vofs. That is, by using, in common, the offset voltage Vofs applied to the HPF 502 as the offset voltage applied to the inversion amplifier 115, the reference voltage of the voltage Vinv becomes stable without receiving the influence of the amplification Ginv of the inversion amplifier 115 or a variation in differential voltage between the offset voltages.

The output signal Vinv of the inversion amplifier 115 is input to the positive terminal of a comparator 116, and compared with a threshold voltage Dth input to the negative terminal of the comparator 116. If Vinv>Dth, the comparator 116 outputs a determination signal CMP set at High level (normal discharge). If Vinv<Dth or Vinv=Dth, the determination signal CMP at Low level is output.

For example, the threshold voltage Dth is settable by a step of 8 mV at 256 ranks from 0.5 V to 2.54 V.

The discharge inspection threshold signal Ddth for setting the threshold voltage Dth is determined as, for example, an 8-bit digital value settable at 256 ranks, and transferred from the signal generator 7 to a shift register 117 in synchronism with the clock signal CLK. Then, the signal is latched by a latch circuit 118 in synchronism with the latch signal LT, and output to a voltage output DAC 119. The output signal of the latch circuit 118 is held during the period T until the next latch timing, and the discharge inspection threshold signal Ddth for setting the next threshold voltage is transferred to the shift register 117 during this time. Note that in the figure, a clock signal inputted to the shift register 117 and a latch signal inputted to the latch circuit 118 are omitted for the sake of simplicity.

By inputting the determination signal CMP to the set input terminal (S) of an RS latch circuit 120, the pulse signal of the determination signal CMP is held (HCMP). When a flip-flop circuit 121 latches the signal HCMP using the latch signal LT as a trigger, the determination result signal RSLT that is set at High level in the next latch period is obtained at the time of normal discharge. The signal HCMP is reset at the fall of the latch signal LT by inputting an inverted signal of the latch signal LT to the reset input terminal (R) of the RS latch circuit 120.

Figure 7C:
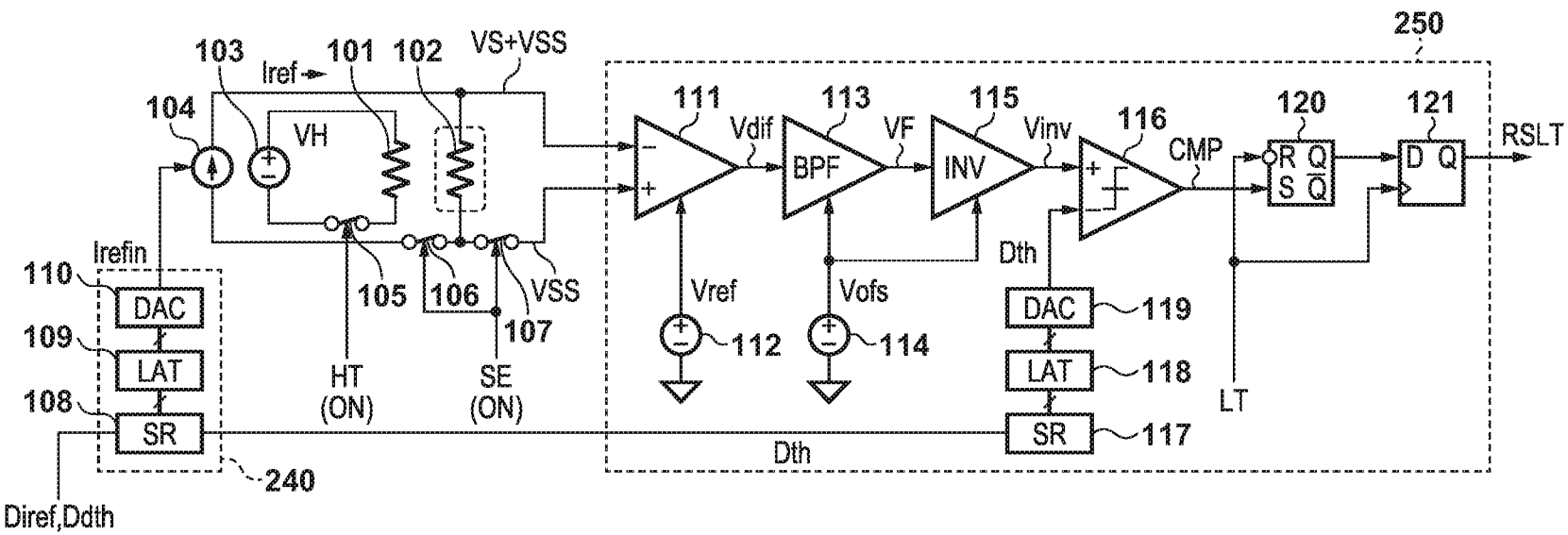

In synchronism with the fall of the latch signal LT, the determination result extraction unit 9 shown in FIGS. 4A and 4B extracts the determination result signal RSLT together with the block signal BLE and the sensor selection signal SDATA delayed by the latch period T. Note that in addition to configurations shown in FIGS. 7A and 7B, as shown in FIG. 7C, the shift registers 108 and 117 may be serially connected. As described with reference to FIG. 4B, this configuration enables the circuit to serially receive a constant electric current signal Diref and a discharge inspection threshold signal Ddth. Also, if a period T shown in FIG. 6 becomes short as a case common to FIGS. 7A to 7C, there is a case where a determination is made in the next block. To handle this case, a delay circuit may be provided so that latch signals inputted to the latch circuits 109 and 118 are delayed.

Embodiments of temperature detection of each print element (heater) in the printhead integrating the element substrate with the above arrangement will be described next.

First Embodiment

Figure 9A:
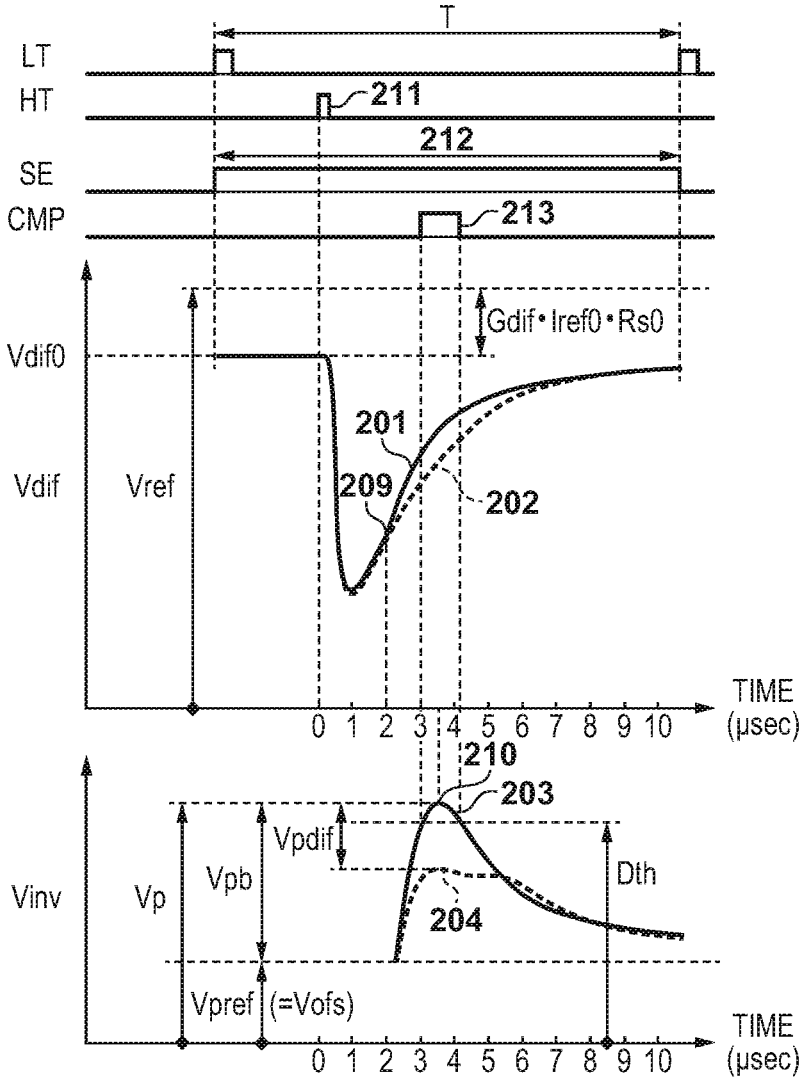
FIG. 9A shows timing charts representing an output waveform Vdif of a differential amplifier and an output waveform Vinv of an inversion amplifier when a pulse of a heater drive signal HT is applied to a heater by energizing a temperature sensor with a constant electric current Iref0 during a latch period T.

FIG. 9A shows timing charts representing an output waveform Vdif of a differential amplifier 111 and an output waveform Vinv of an inversion amplifier 115 when a pulse 211 of a heater drive signal HT is applied to a heater 101 by supplying a constant electric current Iref0 to a temperature sensor 102 during a latch period T.

FIG. 9A shows Vdif and Vinv in a case where a resistance value Rs0 and a temperature resistance coefficient TCR of the temperature sensor 102 at a normal temperature T0 and the resistance value of the heater 101 are smaller than standard values or in a case where the film thickness of an interlayer film that separates the heater 101 and the temperature sensor 102 is larger than a standard value.

In FIG. 9A, in a state in which a sensor energization signal SE is turned on (212), and the temperature sensor 102 is energized with the constant electric current Iref0 (for example, 1.6 mA), the pulse 211 of the heater drive signal HT is applied to the heater 101. At the time of normal discharge, a waveform 201 is obtained as the output waveform Vdif. Since the waveform 201 is upside down as a temperature waveform, a negative gradient indicates a temperature rise process, and a positive gradient indicates a temperature drop process. In the temperature drop process of the waveform 201, the tail (satellite) of an ink droplet discharged from a nozzle to the interface of the heater 101 at the time of normal discharge drops to cool the interface. This causes a feature point 209 to appear, and the waveform 201 indicates that the temperature drop rate increases abruptly after the feature point 209. On the other hand, at the time of a discharge failure, a waveform 202 is obtained as the output waveform Vdif. Unlike the waveform 201 at the time of normal discharge, no feature point 209 appears, and the temperature drop rate gradually decreases in the temperature drop process.

The initial voltage of the waveform 201 or 202 before applying the pulse 211 of the heater drive signal HT is Vdif0 given by equation (7), and the waveform 201 or 202 approaches Vdif0 asymptotically through the temperature drop process. The waveform 201 is output from the inversion amplifier 115 via a BPF 113, thereby obtaining a waveform 203. Similarly, the waveform 202 is output from the inversion amplifier 115, thereby obtaining a waveform 204. The reference voltage of the waveform 203 or 204 is Vofs, and finally approaches Vofs asymptotically through the temperature drop process. In the waveform 203, a peak 210 derived from the highest temperature drop rate after the feature point 209 of the waveform 201 appears, and is compared with a threshold voltage Dth by a comparator 116.

A pulse 213 indicating normal discharge is output to a determination signal CMP in a period in which the threshold voltage Dth is exceeded.

On the other hand, since no feature point 209 appears in the waveform 202, the temperature drop rate is low, the peak appearing in the waveform 204 is lower than the threshold voltage Dth, and no pulse 213 appears in the determination signal CMP output from the comparator 116. As a peak difference Vpdif between the peak of the waveform 203 and that of the waveform 204 increases, a greater difference between the threshold voltage Dth and the peak can be ensured, thereby making it possible to accurately determine the discharge status. The peak difference Vpdif increases by amplifying the output Vinv of the inversion amplifier 115 by an amplifier. Since, however, noise increases in proportion to the amplification, the determination accuracy is not improved.

Therefore, in this embodiment, the differential voltage VS between the two terminals of the temperature sensor 102 is amplified without increasing noise by increasing the constant electric current Iref, and a peak voltage Vp is raised to increase the peak difference Vpdif, thereby improving the determination accuracy.

Figure 9B:
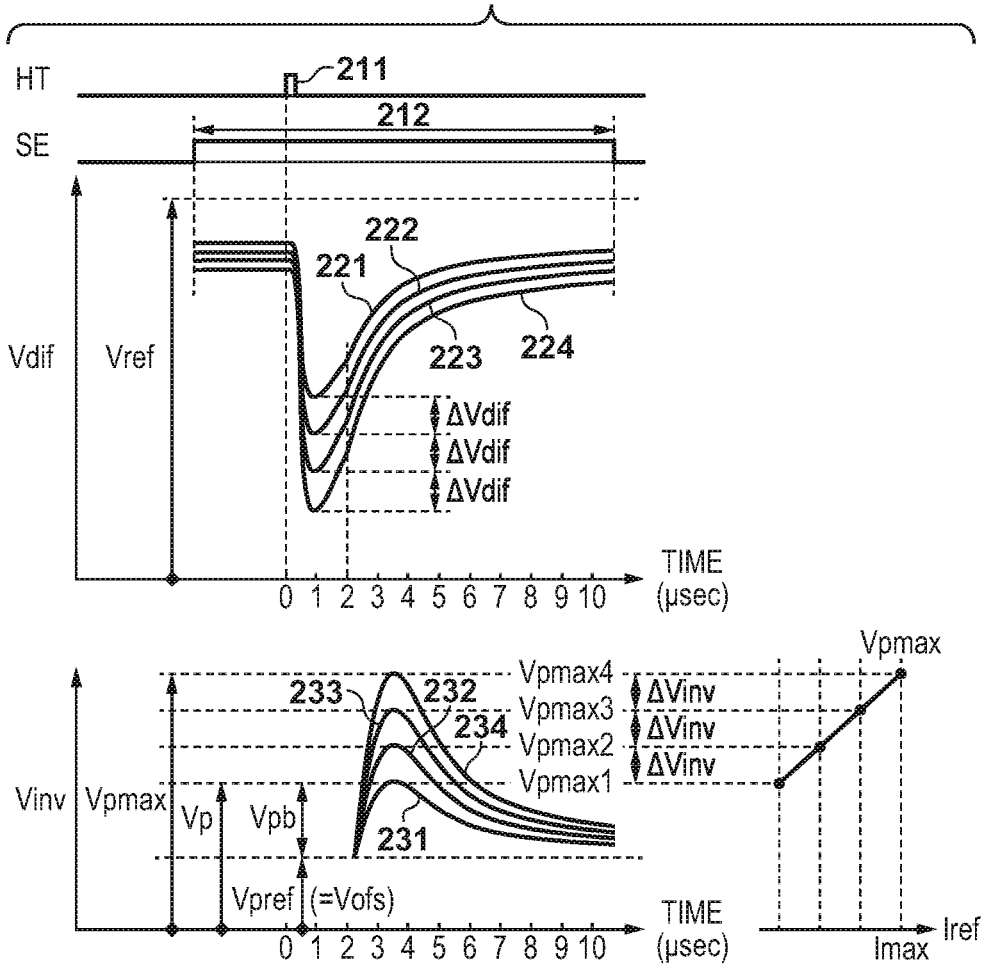
FIG. 9B shows timing charts representing the output waveform Vdif of the differential amplifier and the output waveform Vinv of the inversion amplifier at the time of normal discharge when increasing a constant electric current Iref by one rank.

FIG. 9B shows timing charts representing the output waveform Vdif of the differential amplifier 111 and the output waveform Vinv of the inversion amplifier 115 at the time of normal discharge when increasing a constant electric current Iref by one rank.

Referring to FIG. 9B, a waveform 221 represents the waveform of the output Vdif corresponding to an initial value Iref1 (reference rank) of the constant electric current Iref. An output waveform Vinv 231 corresponds to the waveform 221 of the output Vdif. Similarly, a waveform 222 represents the waveform of the output Vdif corresponding to a constant electric current Iref2. An output waveform Vinv 232 corresponds to the waveform 222 of the output Vdif. A waveform 223 represents the waveform of the output Vdif corresponding to a constant electric current Iref3. An output waveform Vinv 233 corresponds to the waveform 223 of the output Vdif. A waveform 224 represents the waveform of the output Vdif corresponding to a constant electric current Iref4. An output waveform Vinv 234 corresponds to the waveform 224 of the output Vdif.

Since the BPF 113 is a linear filter, as the constant electric current Iref linearly increases, the output Vdif of the differential amplifier 111 linearly decreases, and the output Vinv from the inversion amplifier 115 linearly increases.

That is, if the electric current value of the constant electric current Iref is increased by one rank, the waveform 221 of the output Vdif sequentially changes to the waveforms 222, 223, and 224. The peak of the waveform decreases by ΔVdif corresponding to one rank of Iref.

Along with the change of the waveform of the output Vdif, the peak voltage Vp of the output waveform Vinv 231 of the output Vinv increases by ΔVinv corresponding to one rank of Iref, and the waveform 231 sequentially changes to the waveforms 232, 233, and 234. At this time, the peak voltage Vp linearly increases along with the increase in Iref. As shown in FIG. 9B, Vpmax1 represents the maximum value of the output waveform Vinv 231, Vpmax2 represents the maximum value of the output waveform Vinv 232, Vpmax3 represents the maximum value of the output waveform Vinv 233, and Vpmax4 represents the maximum value of the output waveform Vinv 234.

However, with the characteristic of the operational amplifier forming the differential amplifier 111, the output Vdif of the differential amplifier 111 nonlinearly changes when it becomes equal to or lower than a given voltage. When the voltage further lowers, the voltage is saturated and does not lower anymore. Thus, if the constant electric current Iref is increased to exceed a given electric current value Imax, a phenomenon that the peak voltage Vp conversely lowers occurs.

Figure 9C:
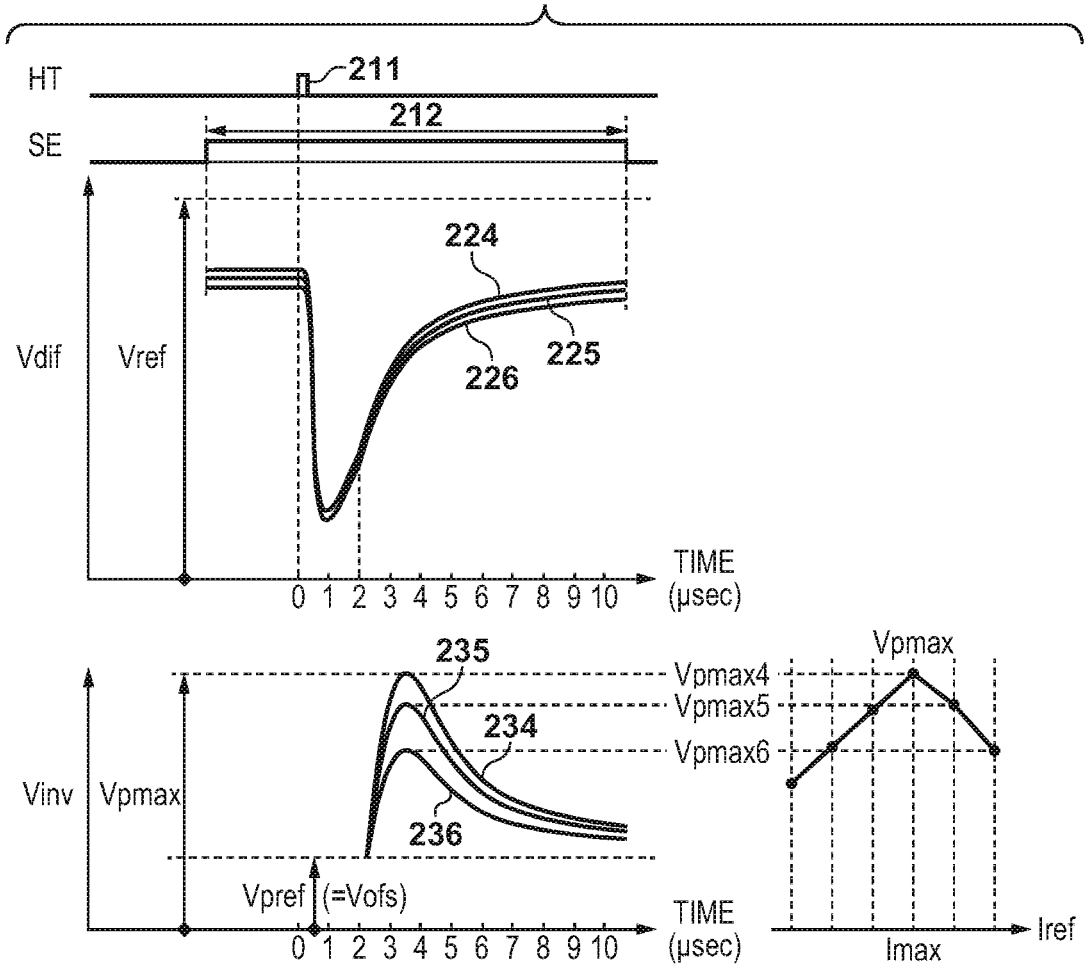
FIG. 9C shows timing charts representing the output waveform Vdif of the differential amplifier and the output waveform Vinv of the inversion amplifier at the time of normal discharge when increasing the constant electric current by one rank.

FIG. 9C shows timing charts representing the output waveform Vdif of the differential amplifier 111 and the output waveform Vinv of the inversion amplifier 115 at the time of normal discharge when increasing the value of the constant electric current by one rank to exceed the constant electric current Iref4.

Referring to FIG. 9C, a waveform 225 represents the waveform of the output Vdif corresponding to a constant electric current Iref5. An output waveform Vinv 235 corresponds to the waveform 225 of the output Vdif. Similarly, a waveform 226 represents the waveform of the output Vdif corresponding to a constant electric current Iref6. An output waveform Vinv 236 corresponds to the waveform 226 of the output Vdif.

Referring to FIG. 9C, if the constant electric current is increased by one rank from the constant electric current Imax, the waveform 224 of the output Vdif nonlinearly changes to decrease from a peak voltage Vpmax4, thereby obtaining the waveform 235. More specifically, the maximum gradient of the waveform 225 at the time of a temperature drop is smaller than that of the waveform 224, and the output Vinv decreases from the waveform 234 whose peak voltage is Vpmax, thereby obtaining the waveform 235. If the constant electric current Iref is increased by one rank, the peak of the waveform 225 of the output Vdif is saturated and does not lower anymore, thereby obtaining the waveform 226. At this time, the maximum gradient of the waveform 226 at the time of a temperature drop is smaller than that of the waveform 225, and the peak of the waveform 235 of the output Vinv further lowers, thereby obtaining the output waveform Vinv 236. The maximum value of the output waveform Vinv 235 is represented by Vpmax5, and the maximum value of the output waveform Vinv 236 is represented by Vpmax6.

As described above, even if the electric current value is increased to exceed the constant electric current Iref4, the peak voltage Vp lowers. In consideration of this, it is apparent that even if the constant electric current Iref is increased unlimitedly, the peak voltage Vp does not always increase to improve the determination accuracy. The peak voltage Vp becomes maximum at a given constant electric current, and even if the value of the constant electric current Iref is increased more, the peak voltage Vp lowers conversely. Therefore, the constant electric current value at which the peak voltage Vp becomes maximum is checked, and adjustment is performed so the constant electric current Iref does not largely deviate from the electric current value, thereby making it possible to keep the determination accuracy as high as possible.

Figure 10:
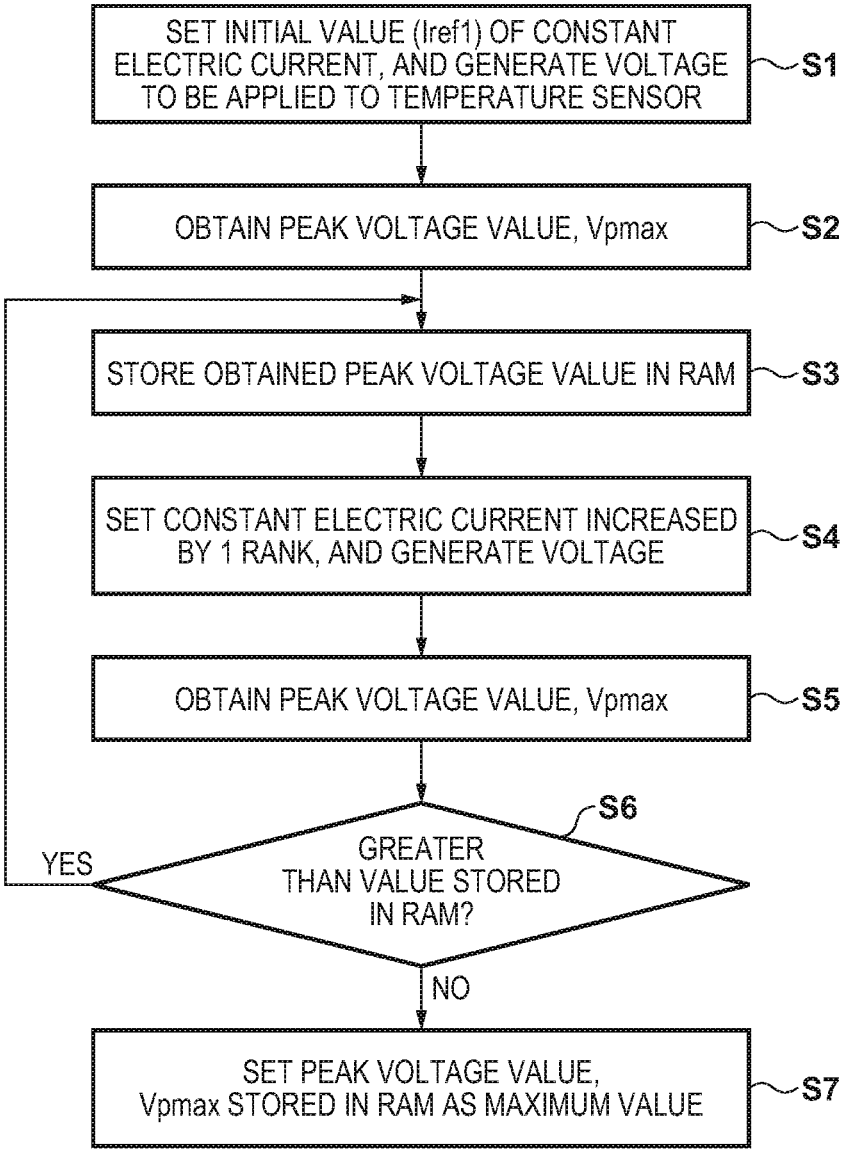
FIG. 10 is a flowchart for explaining constant electric current adjustment processing.

FIG. 10 is a flowchart for explaining constant electric current adjustment processing executed based on the above consideration. This processing is executed by a print controller 419 shown in FIGS. 4A and 4B via a head I/F 427. A constant electric current adjusted by this processing is set as a setting value determined by a constant electric current signal Diref.

In step S1, for one temperature sensor 102 as an adjustment target, the initial value of the constant electric current Iref is determined, and a voltage to be applied to the temperature sensor 102 is generated with the electric current value. In step S2, the peak voltage Vp described with reference to FIGS. 9A and 9B is obtained using a plurality of threshold values for the waveform of the generated voltage. Then, in step S3, the obtained peak voltage Vp is stored in a RAM 421.

In step S4, the current value of the constant electric current Iref is increased by one rank, and a voltage to be applied to the temperature sensor 102 is generated with the current value. In step S5, the peak voltage Vp is obtained using a plurality of threshold values for the waveform of the generated voltage. In step S6, it is determined whether the obtained peak voltage Vp is higher than the peak voltage Vp stored in the RAM 421.

If the peak voltage Vp obtained by supplying the constant electric current whose electric current value is increased by one rank is higher than the peak voltage Vp already stored in the RAM 421, the process returns to step S3 to repeat the same processing. On the other hand, if the peak voltage Vp obtained by supplying the constant electric current whose electric current value is increased by one rank is equal to or lower than the peak voltage Vp already stored in the RAM 421, the process advances to step S7. In step S7, the peak voltage Vp stored in the RAM 421 is set as the maximum value.

Details of the processes in steps S2 and S5 will now be described with reference to FIGS. 11 and 12.

Figure 11:
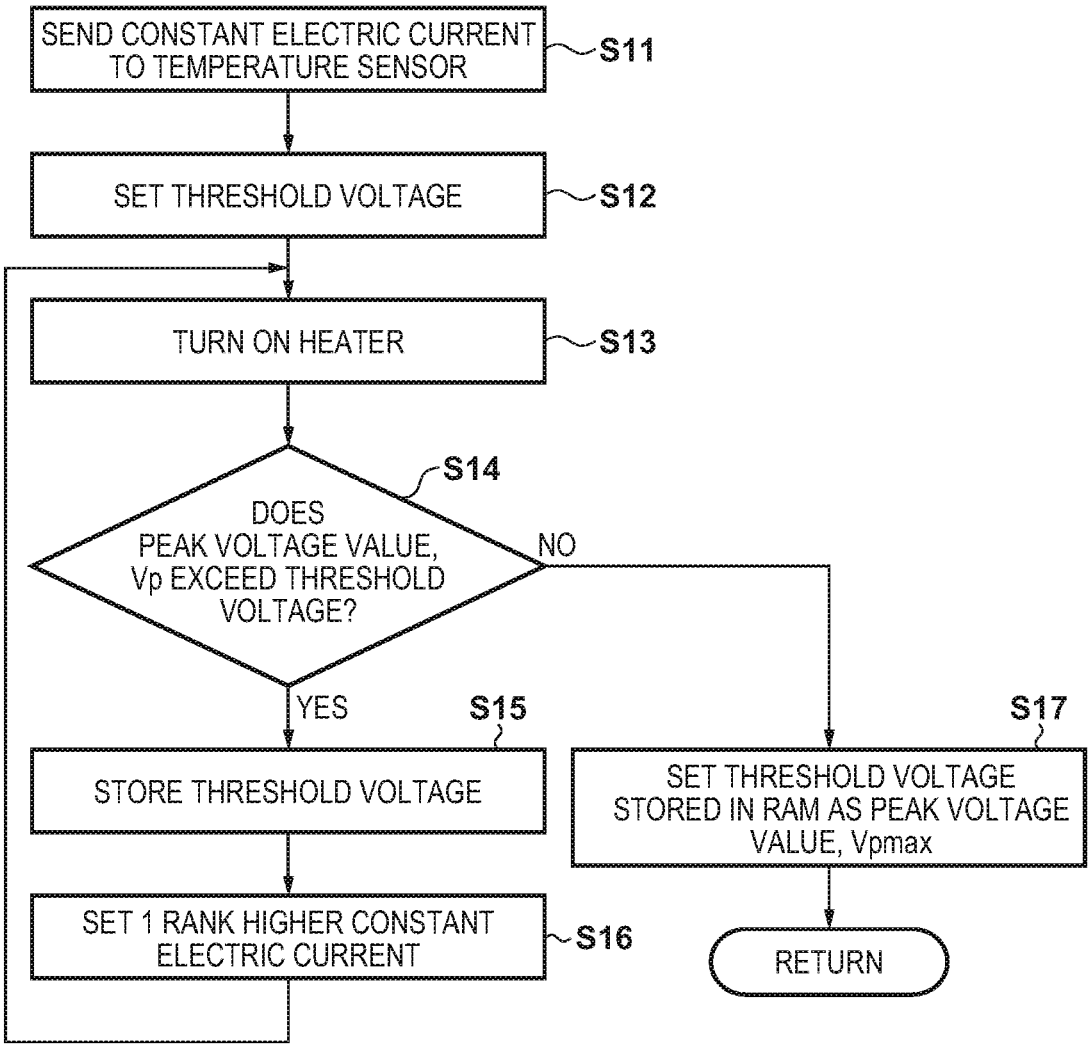
FIG. 11 is a flowchart illustrating detailed processing of peak voltage obtaining processing shown in steps S2 and S5 of FIG. 10.

FIG. 11 is a flowchart illustrating detailed processing of the peak voltage obtaining processing shown in steps S2 and S5. FIG. 12 is a timing chart showing a change in determination signal when a threshold voltage is changed. FIG. 12 shows an example of setting the threshold voltage by changing it from a threshold voltage Dth0 to a threshold voltage Dth5.

In step S11, the temperature sensor 102 is energized with the constant electric current. In step S12, the threshold voltage is set. Initially, Dth0 is set as the threshold voltage Dth. In step S13, the heater 101 is turned on. In step S14, it is determined whether the peak voltage Vp from the temperature sensor 102 exceeds the threshold voltage before a predetermined time (10 μsec) elapses.

These processes will be described with reference to the arrangement of the circuit shown in each of FIGS. 7A and 7B.

During the first latch period T, a signal generator 7 sets a reference setting value Diref0 in the constant electric current signal Diref, and transmits Ddth0 as the discharge inspection threshold signal Ddth to an element substrate 5. Accordingly, in a state in which the temperature sensor 102 is energized with the constant electric current Iref0 (for example, 1.6 mA) corresponding to the reference setting value Diref0, the pulse 211 of the heater drive signal HT is applied to the heater 101. At this time, the reference setting value Ddth0 corresponding to the reference threshold voltage Dth0 is input to the comparator 116, and compared with the peak value 210 of the peak voltage Vp.

If it is determined that the peak voltage Vp exceeds the threshold voltage Dth0, the process advances to step S15. In step S15, the threshold voltage is stored in the RAM 421. In step S16, the threshold voltage Dth1 that is higher by one rank is set. The process returns to step S13 to repeat the same processing.

On the other hand, if it is determined that the peak voltage Vp is equal to or lower than the threshold voltage Dth0, the process advances to step S17. In other words, if no is determined in step S14, the threshold voltage stored in the RAM 421 is set as a peak voltage in step S17.

In the circuit shown in each of FIGS. 7A and 7B, if the comparator 116 determines that the peak value 210 of the peak voltage Vp exceeds the threshold voltage Dth0, a pulse 214 is output to the determination signal CMP. The element substrate 5 outputs, to a determination result extraction unit 9, a determination result signal RSLT corresponding to the pulse 214. After receiving the determination result signal RSLT, the signal generator 7 raises the rank of the threshold voltage Dth by one during the next latch period T, and the threshold voltage Dth1 is compared with the obtained peak value 210 of the peak voltage Vp.

Figure 12:
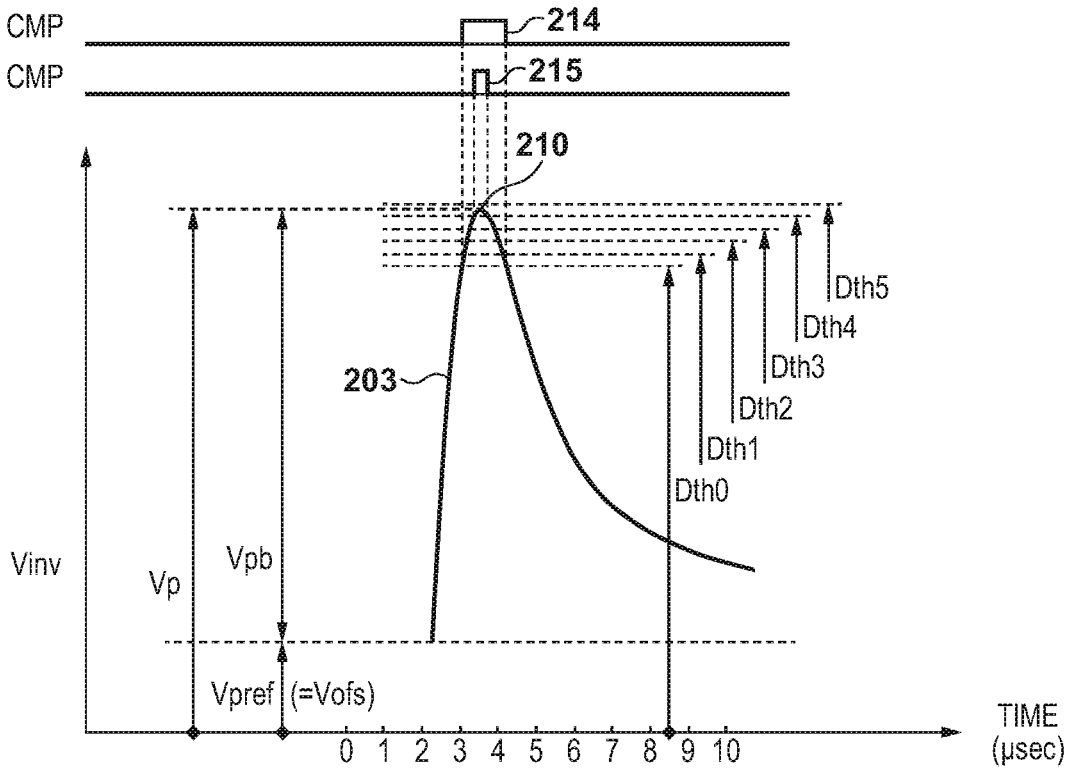
FIG. 12 is a timing chart showing a change in determination signal when a threshold voltage is changed.

Considering the example shown in FIG. 12, the above processing is repeated up to the threshold voltage Dth5 at which no pulse is output to the determination signal CMP, and the threshold voltage Dth4 of the rank at which a pulse 215 is finally output to the determination signal CMP is set as the peak voltage Vp. If the peak voltage Vp is obtained, the constant electric current Iref is increased by one rank, and the threshold voltage is set in the same manner, thereby obtaining the peak voltage Vp.

On the other hand, if no pulse is output to the determination signal CMP during the first latch period T, the rank of the threshold voltage Dth is decreased by one during the next latch period T, and the threshold voltage Dth is compared with the peak value 210 of the peak voltage Vp obtained by performing the same processing as that described above. Such processing is repeated until the pulse is output to the determination signal CMP, and the threshold voltage of the rank at which the pulse is output is set as the peak voltage Vp.

The above-described processing of detecting the peak voltage Vp is performed every time the rank of the constant electric current Iref is increased by one. Then, for example, if it is confirmed that the peak voltage Vp successively lowers by two ranks, the peak voltage of the waveform before the peak voltage Vp lowers is set as the maximum peak voltage Vpmax, and the constant electric current Iref at this time is set as the maximum constant electric current Imax. The constant electric current Iref that is obtained by decreasing the maximum constant electric current Imax by one or two ranks in consideration of a margin is confirmed as an adjusted constant electric current Iadj. Note that the threshold voltage Dth is set to a voltage value obtained when a peak voltage Vpadj detected by energizing the temperature sensor 102 with the constant electric current Iadj is lowered by a predetermined number of ranks (for example, six ranks) necessary to determine normal discharge with desired accuracy.

Note that the processing of adjusting the constant electric current with which the one temperature sensor 102 is energized has been described with reference to FIG. 10. The same processing is also executed for the next temperature sensor 102 implemented in the element substrate 5, and an optimum constant electric current value for each of all the temperature sensors is determined. During execution of the adjustment processing, the adjusted constant electric current value is stored in the RAM 421. However, the adjusted constant electric current value is stored in the nonvolatile memory (for example, an EEPROM) of the print controller 419 for temperature detection processing in a subsequent print operation.

Therefore, according to the above-described embodiment, the constant electric current Imax at which the peak voltage Vp of the output waveform of the inversion amplifier 115 becomes maximum is checked, and the constant electric current Iref can be adjusted not to exceed the maximum constant electric current Imax. This makes it possible to keep the accuracy of determination of the discharge status high by adjusting the peak voltage Vp as high as possible, thereby highly reliably determining the ink discharge status of the nozzle.

Second Embodiment

The first embodiment assumes that the accuracy of determination of the discharge status is kept as high as possible by adjusting the peak voltage Vp as high as possible. However, if such adjustment is performed, the peak voltage Vp varies for each nozzle due to the influence of various variation factors, and it is necessary to set both the constant electric current Iref and the threshold voltage Dth for each nozzle. Thus, the signal generator 7 needs to output the constant electric current signal Diref and the threshold signal Ddth for each nozzle. To do this, a memory area for the constant electric current signals Diref and the threshold signals Ddth for all the nozzles needs to be allocated to the RAM 421.

In this embodiment, in consideration of the above problem, it is possible to determine the discharge statuses of all nozzles using one threshold voltage Dth by adjusting a constant electric current Iref to align a peak voltage Vp of an output Vinv with a setting voltage Vpe.

To determine the setting voltage Vpe, a set of a plurality of constant electric current values and a threshold voltage is obtained for respective nozzles by the method described in the first embodiment.

Figure 13:
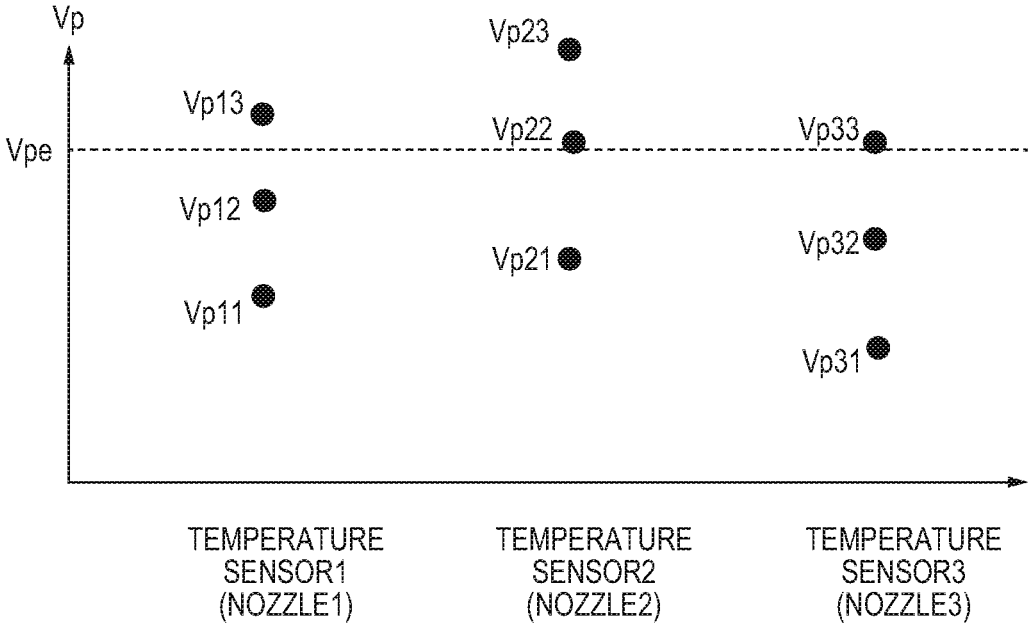
FIG. 13 is a view for explaining a method of obtaining a setting voltage for three temperature sensors.

FIG. 13 is a view for explaining a method of obtaining a setting voltage for three temperature sensors.

Referring to FIG. 13, an element substrate includes three temperature sensors 1, 2, and 3 for the sake of simplicity of the explanation, and electric currents and voltages of three levels will be exemplified.

Temperature sensor 1 detects discharge of nozzle 1, temperature sensor 2 detects discharge of nozzle 2, and temperature sensor 3 detects discharge of nozzle 3. As shown in FIG. 13, peak voltages Vp11, Vp12, and Vp13 are obtained for temperature sensor 1, and the maximum voltage is the peak voltage Vp13. Peak voltages Vp21, Vp22, and Vp23 are obtained for temperature sensor 2, and the maximum voltage is the peak voltage Vp23. Furthermore, peak voltages Vp31, Vp32, and Vp33 are obtained for temperature sensor 3, and the maximum voltage is the peak voltage Vp33.

Figure 14:
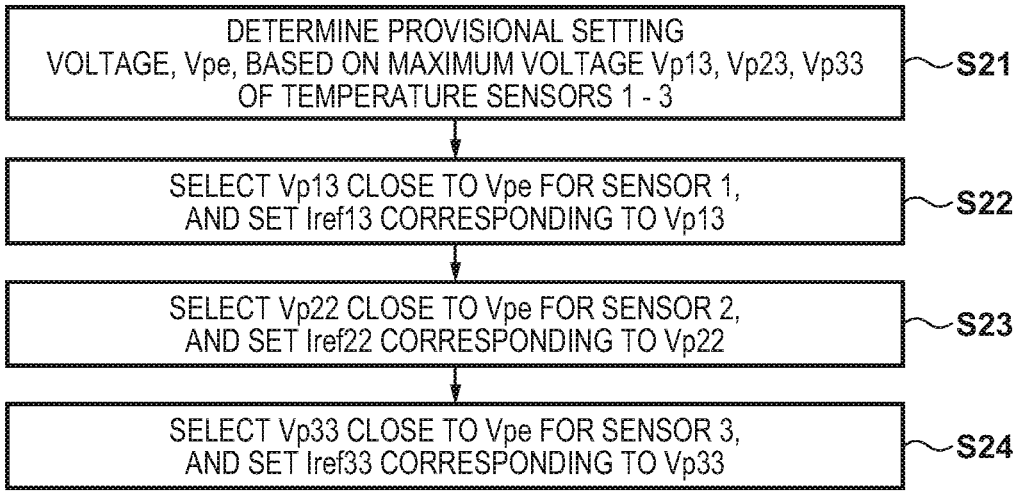
FIG. 14 is a flowchart illustrating processing of determining a setting voltage Vpe.

FIG. 14 is a flowchart illustrating processing of determining the setting voltage Vpe.

According to this flowchart, in step S21, among the three maximum voltages Vp13, Vp23, and Vp33, the lowest voltage Vp33 is determined as a provisional setting voltage Vpe. In step S22, for temperature sensor 1, among the peak voltages Vp11, Vp12, and Vp13, the voltage Vp13 close to the provisional setting voltage Vpe is selected, and an electric current value Iref13 corresponding to Vp13 is set as an electric current setting value of temperature sensor 1.

In step S23, the same processing is performed for temperature sensor 2. That is, for temperature sensor 2, the voltage Vp22 close to the provisional setting voltage Vpe is selected, and an electric current value Iref22 corresponding to Vp22 is set as an electric current setting value of temperature sensor 2.

In step S24, the same processing is performed for temperature sensor 3. That is, for temperature sensor 3, the voltage Vp33 close to the provisional setting voltage Vpe is selected, and an electric current value Iref33 corresponding to Vp33 is set as an electric current setting value of temperature sensor 3.

As the threshold voltage Dth, the threshold voltage Dth of the nozzle for which a peak voltage Vpadj is set as the setting voltage Vpe is used.

Figure 15:
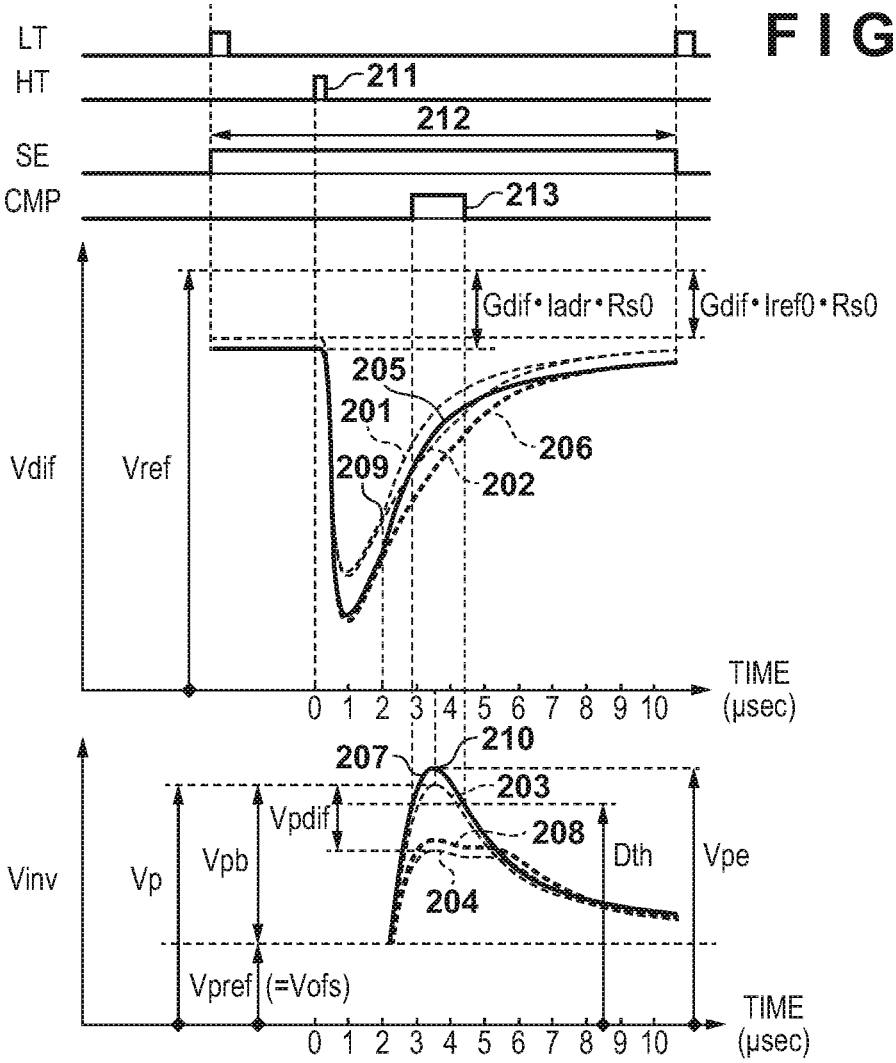
FIG. 15 shows timing charts representing an output waveform Vdif of a differential amplifier and an output waveform Vinv of an inversion amplifier when a pulse of a heater drive signal HT is applied to a heater while energizing a temperature sensor with an adjusted constant electric current Iadr.

FIG. 15 shows timing charts representing an output waveform Vdif of a differential amplifier 111 and an output waveform Vinv of an inversion amplifier 115 when a pulse 211 of a heater drive signal HT is applied to a heater 101 while energizing a temperature sensor 102 with an adjusted constant electric current Iadr. The constant electric current Iadr in FIG. 15 is adjusted to have a current value of a lowest rank with the constant electric current Iref at which the peak voltage Vp is equal to or higher than the setting voltage Vpe.

If the constant electric current Iref is raised from a reference setting value Iref0 to Iadr, an output waveform 201 of the differential amplifier 111 changes into a waveform 205 at the time of normal discharge. At the time of a discharge failure, an output waveform 202 of the differential amplifier 111 changes into a waveform 206. Furthermore, an output waveform 203 of the inversion amplifier 115 changes into a waveform 207 at the time of normal discharge, and an output waveform 204 of the inversion amplifier 115 changes into a waveform 208 at the time of a discharge failure.

Figure 16:
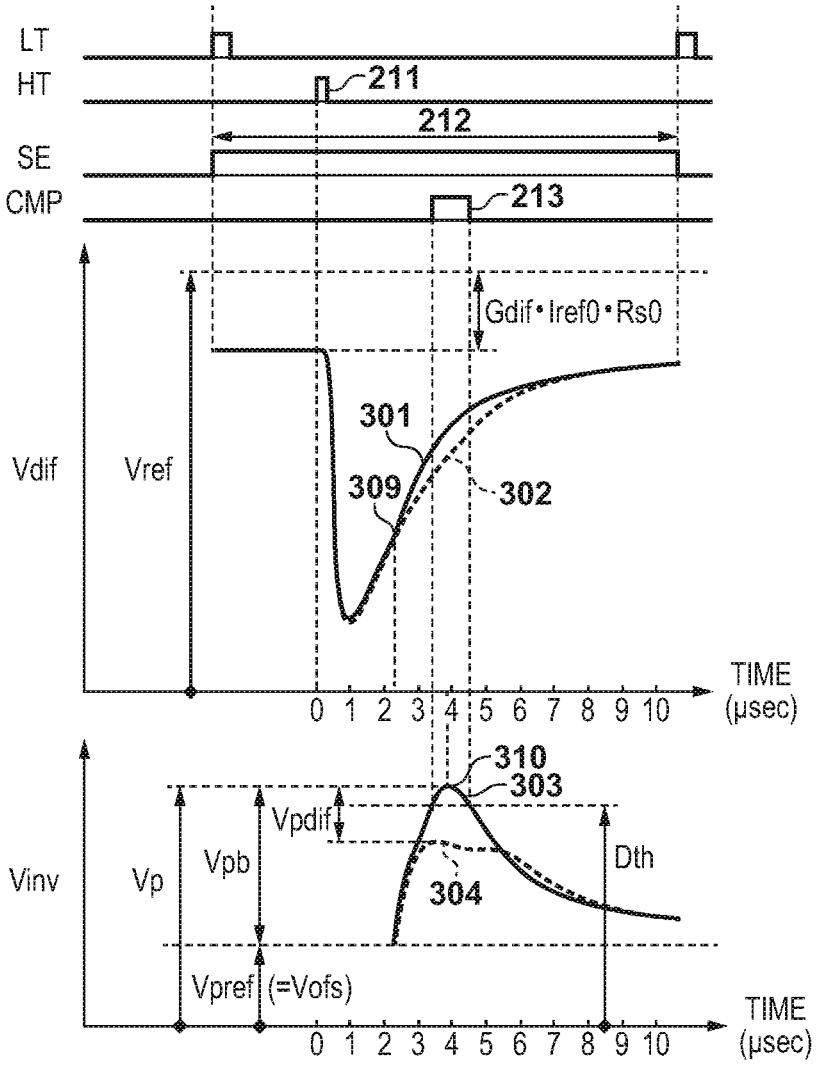
FIG. 16 shows timing charts representing the output waveform Vdif of the differential amplifier and the output waveform Vinv of the inversion amplifier when the pulse of the heater drive signal HT is applied to the heater while energizing the temperature sensor with an unadjusted constant electric current Iref0.

FIG. 16 shows timing charts representing the output waveform Vdif of the differential amplifier 111 and the output waveform Vinv of the inversion amplifier 115 when the pulse 211 of the heater drive signal HT is applied to the heater 101 while energizing the temperature sensor 102 with the unadjusted constant electric current Iref0.

FIG. 16 shows Vdif and Vinv when the appearance time of a feature point 309 is later than reference time (for example, 0.4 μsec later) or when a drop amount of the tail (satellite) of a discharged ink droplet onto the interface of the heater 101, which is a factor for causing the feature point 309, is smaller than a reference amount.

Referring to FIG. 16, since a resistance value Rs0 and a temperature resistance coefficient TCR of the temperature sensor 102 and the resistance value of the heater 101 are standard values, a waveform 302 of the output Vdif and a waveform 304 of the output Vinv at the time of a discharge failure are almost the same as reference waveforms obtained when there are no variations.

On the other hand, the temperature drop rate of a waveform 301 of the output Vdif after the feature point 309 at the time of normal discharge is lower than that of the reference waveform. As a result, the peak voltage Vp of a peak 310 of a waveform 303 of the output Vinv at the time of normal discharge is lower than the peak voltage of the reference waveform. Consequently, the voltage Vpdif shown in FIG. 16 is higher than that shown in FIG. 9A.

Figure 17:
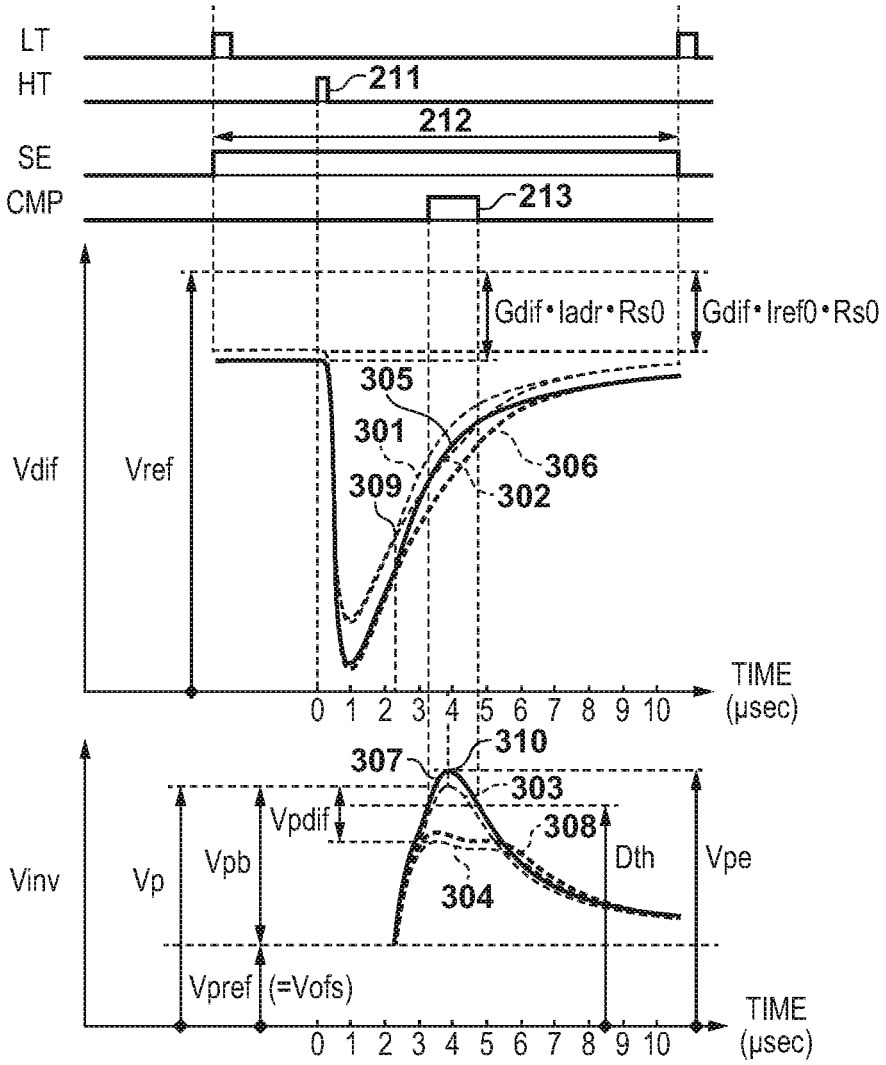
FIG. 17 shows timing charts representing the output waveform Vdif of the differential amplifier and the output waveform Vinv of the inversion amplifier when the pulse of the heater drive signal HT is applied to the heater while energizing the temperature sensor with the adjusted constant electric current Iadr.

FIG. 17 shows timing charts representing the output waveform Vdif of the differential amplifier 111 and the output waveform Vinv of the inversion amplifier 115 when the pulse 211 of the heater drive signal HT is applied to the heater 101 while energizing the temperature sensor 102 with the adjusted constant electric current Iadr.

The constant electric current Iadr shown in FIG. 17 adjusts the value of an electric current, which flows into each sensor, to an electric current value of a lowest rank within an electric current range where the peak voltage Vp is equal to or higher than the setting voltage Vpe. For example, as shown in FIG. 13, if the three temperature sensors are adjustment targets, temperature sensor 1 sets an electric current value corresponding to the maximum voltage VP13, temperature sensor 2 sets an electric current value corresponding to the maximum voltage VP22, and temperature sensor 3 sets an electric current value corresponding to the maximum voltage VP33.

If the constant electric current Iref is changed from the reference setting value Iref0 to Iadr, the output waveform 301 of the differential amplifier 111 at the time of normal discharge changes into a waveform 305, and the output waveform 302 of the differential amplifier 111 at the time of a discharge failure changes into a waveform 306. In addition, the output waveform 303 of the inversion amplifier 115 at the time of normal discharge changes into a waveform 307, and the output waveform 304 of the inversion amplifier 115 at the time of a discharge failure changes into a waveform 308.

At this time, the peak voltage Vp of the waveform 303 is set as the peak voltage Vpe of the waveform 307, and coincides with the peak voltage Vpe of the waveform 207 shown in FIG. 15. On the other hand, the peak of the waveform 308 is multiplied by a ratio of (1−Vpdif/Vpb) to obtain Vpe(1−Vpdif/Vpb), which is larger than the peak of the waveform 208 shown in FIG. 15. As a result, the peak difference Vpdif after the constant electric current Iref is adjusted is smaller than in the case shown in FIG. 15. However, it is possible to accurately determine the discharge status by setting the threshold voltage Dth so as to ensure sufficient accuracy of determination of a discharge failure by assuming such variation.

Therefore, according to the above-described embodiment, it is possible to adjust the constant electric current Iref so that the peak voltage Vp of the output waveform of the inversion amplifier 115 is aligned with the setting voltage Vpe. Thus, it is possible to determine the discharge statuses of all the nozzles using the one threshold voltage Dth, and a signal generator 7 need not output the threshold signal Ddth for each nozzle, thereby reducing the information amount of the threshold signal Ddth stored in a RAM 421 or an EEPROM.

Third Embodiment

In the first embodiment, the determination accuracy is improved by raising the rank of the constant electric current Iref as much as possible to maximize the peak voltage Vp. However, if the constant electric current Iref is too large, the deterioration of the temperature sensor 102 may be accelerated. In consideration of this problem, this embodiment employs an arrangement in which the rank of a constant electric current Iref is not raised after a peak difference Vpdif sufficient to achieve necessary determination accuracy is ensured.

As the peak difference Vpdi, shown in FIG. 9A, of an output Vinv of an inversion amplifier increases, a greater difference between a threshold voltage Dth and the peak can be ensured, thereby determining the discharge status accurately. Therefore, it is possible to ensure necessary determination accuracy by confirming that the peak difference Vpdif ensures a desired voltage width, but it is generally difficult to reproduce a discharge failure status at any desired timing. Therefore, a method of adjusting the constant electric current Iref so that a peak voltage Vp in normal discharge becomes a predetermined voltage instead of the peak difference Vpdif is considered. However, in fact, a reference voltage Vofs of the inversion amplifier varies, and thus the peak voltage Vp cannot be substituted for the peak difference Vpdif. That is, an unexpected offset voltage may be superimposed on an output VF and the output Vinv due to a slight variation in symmetricity of the differential amplification stage of an operational amplifier forming a BPF 113 or an inversion amplifier 115.

Therefore, even if the peak voltage Vp is higher than a predetermined setting voltage Vpe, an unexpected offset voltage is superimposed in the positive direction, and thus peak voltage Vp may be higher apparently. Therefore, adjustment of the constant electric current Iref may degrade the determination accuracy.

Based on the above consideration, a reference voltage Vref of the output Vinv including the unexpected offset voltage is detected in advance, and the constant electric current Iref is adjusted to align the differential voltage between the reference voltage Vpref and the peak voltage Vp of the output Vinv with the predetermined voltage Vpe.

Figure 18:
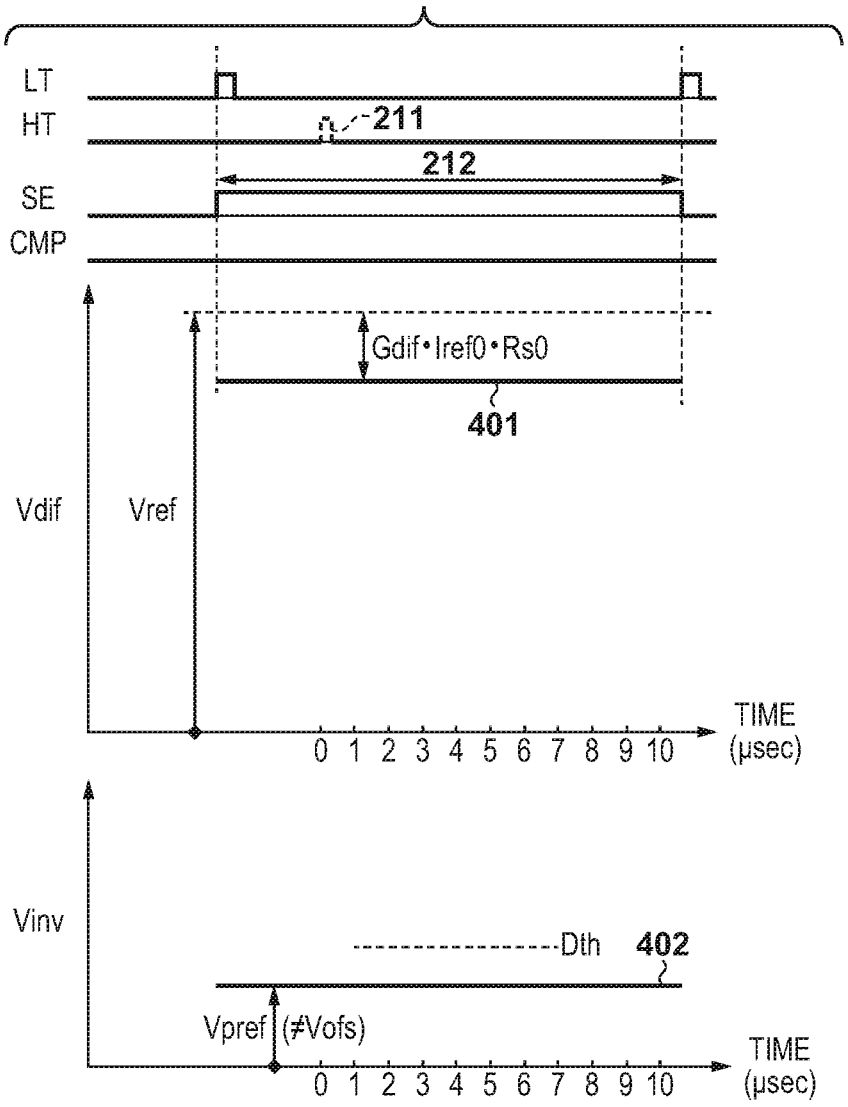
FIG. 18 shows timing charts representing an output waveform Vdif of a differential amplifier and an output waveform Vinv of an inversion amplifier when no pulse of a heater drive signal HT is applied to a heater while energizing a temperature sensor with a constant electric current during the ON period of a sensor energization signal SE.

FIG. 18 shows timing charts representing an output waveform Vdif of a differential amplifier 111 and an output waveform Vinv of an inversion amplifier 115 when no pulse of a heater drive signal HT is applied to a heater 101 while energizing a temperature sensor 102 with a constant electric current during the ON period of a sensor energization signal SE.

Consider a case (broken line 211) in which no pulse 211 of the heater drive signal HT is applied to the heater 101 in a state in which the temperature sensor 102 is energized with a constant electric current Iref0 (for example, 1.6 mA), as shown in FIG. 18. In this case, the temperature of the temperature sensor 102 remains at a normal temperature T0 without rising, and a waveform 401 of the output voltage Vdif indicates a constant voltage, as given by equation (7). At this time, an output VF from a BPF 113 is given by Vofs+Vofs1 by superimposing an unexpected offset voltage Vofs1 on an offset voltage Vofs applied by a constant voltage source 114.

When Vofs2 represents an unexpected offset voltage to be superimposed on the output Vinv from the inversion amplifier 115, in accordance with equation (6), the output Vinv is given by:

$$Vinv=Vpref=Vofs+Vofs2+Ginv(Vofs2-Vofs1) \quad (8)$$

That is, the reference voltage Vpref of the output Vinv varies from the constant voltage Vofs by Vofs2+Ginv(Vofs2−Vofs1). A waveform 402 represents the reference voltage Vpref. In this embodiment, the temperature sensor 102 is energized with the constant electric current Iref0 by the same method as that when the peak voltage Vp is detected in the first embodiment. In a state in which no pulse of the heater drive signal is applied to the heater 101, the output voltage Vinv and the threshold voltage are compared with each other, thereby detecting the reference voltage Vpref using a comparator 116.

In addition, the peak voltage Vp obtained when energizing the temperature sensor 102 with the constant current Iref0, and applying the pulse 211 of the heater drive signal to the heater 101 is detected using the comparator 116 by the same method as in the first embodiment. Since the differential voltage (Vp−Vpref) between the peak voltage Vp and the reference voltage Vpref is proportional to the constant electric current Iref, a constant electric current Iadj corresponding to the target setting voltage Vpe is obtained by:

$$Iadj=Iref0\times\{(Vpe-Vpref)/(Vp-Vpref)\} \quad (9)$$

By confirming that the differential voltage (Vp−Vpref) between the reference voltage Vpref and the peak voltage Vp detected when the temperature sensor 102 is energized with the constant electric current Iadj is equal to (Vpe−Vpref), it is possible to confirm the constant electric current value Iadj as an adjusted constant electric current value.

Therefore, according to the above-described embodiment, it is possible to detect the reference voltage Vpref in addition to the peak voltage Vp of the inversion amplifier 115, and adjust the constant electric current Iref based on the differential voltage. Thus, even if an unexpected offset voltage is superimposed on the output from the inversion amplifier 115 or the HPF 502 due to a manufacturing variation, it is possible to ensure the peak difference Vpdif sufficient to achieve the necessary accuracy of determination of the discharge status. This can prevent the deterioration of the temperature sensor 102 from being accelerated by satisfactorily adjusting the constant electric current Iref without unnecessarily raising it.

Although the first to third embodiments have been described, the present invention is not limited to the above-described values or arrangements. For example, the low-pass filter or high-pass filter forming the bandpass filter may be a digital filter such as an FIR filter or IIR filter formed by a digital circuit, instead of an analog filter formed by an analog circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-062259, filed Mar. 28, 2018, which is hereby incorporated by reference herein in its entirety.

What is claimed is:

1. An element substrate comprising:

a heater configured to heat ink and discharge ink from a nozzle;

a temperature sensor provided in correspondence with the heater;

a digital-to-analog converter configured to convert an externally input first signal to an analog signal;

an electric current source configured to energize the temperature sensor with an electric current based on an electric current value specified by the analog signal converted by the digital-to-analog converter; and a determination circuit configured to determine an ink discharge status of the nozzle based on a voltage output from the temperature sensor energized with the electric current and a threshold voltage specified by an externally input second signal, and output a determination result signal.

2. The element substrate according to claim 1, wherein the electric current source is driven based on the electric current value specified by the analog signal.

3. The element substrate according to claim 2, further comprising:

a first shift register configured to receive the first signal; and a first latch circuit configured to latch, in accordance with an externally input latch signal, the first signal received by the first shift register.

4. The element substrate according to claim 1, wherein the determination circuit includes:

a differential amplifier configured to amplify a voltage output from the temperature sensor;

a filter configured to suppress noise included in a voltage signal output from the differential amplifier;

an inversion amplifier configured to invert a signal output from the filter; and a comparator configured to compare a signal output from the inversion amplifier with the threshold voltage specified by the second signal, and the determination circuit outputs the determination result signal based on a result of the comparison by the comparator.

5. The element substrate according to claim 1, wherein the electric current value specified by the analog signal is settable by a predetermined step-width at a plurality of steps, and the threshold voltage specified by the second signal is settable by a predetermined step-width at a plurality of ranks.

6. The element substrate according to claim 1, further comprising:

a first switch configured to turn on/off energization to the temperature sensor; and a second switch configured to turn on/off energization to the heater, wherein the first switch is turned on/off by an externally input sensor energization signal, and the second switch is turned on/off by an externally input print data signal.

7. The element substrate according to claim 1, wherein the first signal and the second signal are input to a common terminal.

8. The element substrate according to claim 1, wherein the heater comprises a plurality of heaters, and the temperature sensor comprises a plurality of temperature sensors in correspondence with the plurality of heaters.

9. The element substrate according to claim 1, wherein the element substrate has a multilayer wiring structure including the temperature sensor immediately below the heater.

10. A printhead comprising:

a nozzle; and an element substrate, wherein the element substrate comprises:

a heater configured to heat ink and discharge ink from the nozzle;

a temperature sensor provided in correspondence with the heater;

a digital-to-analog converter configured to convert an externally input first signal to an analog signal;

an electric current source configured to energize the temperature sensor with an electric current based on an electric current value specified by the analog signal converted by the digital-to-analog converter; and a determination circuit configured to determine an ink discharge status of the nozzle based on a voltage output from the temperature sensor energized with the electric current and a threshold voltage specified by an externally input second signal, and output a determination result signal.

11. The printhead according to claim 10, wherein the printhead comprises a full-line printhead.

12. A printing apparatus comprising:

a printhead comprising a heater configured to heat ink and discharge ink from a nozzle, a temperature sensor provided in correspondence with the heater, a digital-to-analog converter configured to convert an externally input first signal to an analog signal, an electric current source configured to energize the temperature sensor with an electric current based on an electric current value specified by the analog signal converted by the digital-to-analog converter, and a determination circuit configured to determine an ink discharge status of the nozzle based on a voltage output from the temperature sensor energized with the electric current and a threshold voltage specified by an externally input second signal, and output a determination result signal;

a signal generation unit configured to generate the first signal and the second signal for the printhead, and transmit the first signal and the second signal to the printhead;

a reception unit configured to receive the determination result signal; and a change unit configured to change at least one of a value of the first signal and a value of the second signal based on the determination result signal received by the reception unit.

13. The apparatus according to claim 12, wherein the first signal and the second signal are transmitted from the signal generation unit to the printhead via a common signal line.

14. The apparatus according to claim 12, wherein the change unit changes the value of the first signal to change the electric current value from a predetermined initial value of the electric current by a predetermined step-width, and changes the value of the second signal to change the threshold voltage from a predetermined initial value of the threshold voltage by a predetermined step-width.

* * * * *